US010336092B2

(12) United States Patent
Kayanaka

(10) Patent No.: US 10,336,092 B2
(45) Date of Patent: Jul. 2, 2019

(54) IMAGE FORMATION DEVICE

(71) Applicant: BROTHER KOGYO KABUSHIKI KAISHA, Nagoya (JP)

(72) Inventor: Yoshihisa Kayanaka, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 133 days.

(21) Appl. No.: 15/716,750

(22) Filed: Sep. 27, 2017

(65) Prior Publication Data

US 2018/0281448 A1 Oct. 4, 2018

(30) Foreign Application Priority Data

Mar. 31, 2017 (JP) ..... 2017-073139

(51) Int. Cl.

| | |
|---|---|
| ***B41J 2/21*** | (2006.01) |
| ***B41J 2/07*** | (2006.01) |
| ***B41J 19/14*** | (2006.01) |
| ***B41J 3/54*** | (2006.01) |
| *B41J 3/407* | (2006.01) |
| *B41J 2/045* | (2006.01) |
| *B41J 2/14* | (2006.01) |

(52) U.S. Cl.

CPC ..... *B41J 2/2135* (2013.01); *B41J 2/2132* (2013.01); *B41J 3/543* (2013.01); *B41J 19/145* (2013.01); *B41J 2/04581* (2013.01); *B41J 2/14008* (2013.01); *B41J 3/4078* (2013.01)

(58) Field of Classification Search

CPC ..... B41J 2/2132; B41J 2/2135; B41J 19/145; B41J 2/07; B41J 3/4078

See application file for complete search history.

(56) References Cited

U.S. PATENT DOCUMENTS

2013/0194334 A1 8/2013 Watanabe
2018/0281449 A1* 10/2018 Kayanaka ..... B41J 2/2135

FOREIGN PATENT DOCUMENTS

JP 2013-154511 A 8/2013
JP 2013-154517 A 8/2013
JP 2013156772 * 8/2013 ..... G06F 3/12
JP 2013-173350 A 9/2013
JP 5919843 B2 * 5/2016 ..... G06F 3/12353

OTHER PUBLICATIONS

U.S. Appl. No. 15/716,760, filed Sep. 27, 2017 titled "Image Formation Device" (related to above U.S. Appl. No. 15/716,750).

* cited by examiner

*Primary Examiner* — Huan H Tran
(74) *Attorney, Agent, or Firm* — K&L Gates LLP

(57) ABSTRACT

An image formation device includes a plurality of first nozzles which eject a first ink, a plurality of second nozzles which eject a second ink, a processor which forms an image of a resolution R [dpi] on the basis of print data, and a memory which stores computer-readable instructions that, when executed by the processor, perform a process including performing an ejection control, when printing of adjacent D×R pixels is performed by the first ink at a high density Ph [%] that is higher than a unit density Pu [%], such that total densities of the second ink ejected onto each of the pixels in the pixel array by the plurality of times of scanning are, respectively, substantially the same as a maximum density of the second ink able to be ejected at one time from the second nozzles.

9 Claims, 16 Drawing Sheets

FIG. 7

421

| | | | | | |
|---|---|---|---|---|---|
| HEADER INFORMATION | RESOLUTION | | | | |
| | DENSITY INFORMATION | | | | |
| | PLATEN INFORMATION | | | | |
| | PRINT METHOD SPECIFICATION INFORMATION | | | | |
| RASTER INFORMATION | PIXEL ARRAY NUMBER | COLOR INFORMATION | LEFT MARGIN | RIGHT MARGIN | RASTER DATA |
| | 1 | WHITE 1 | ··· | ··· | 1 1 1 1 1 1 1 1 1 1 ··· 1 1 |
| | | WHITE 2 | ··· | ··· | 1 1 1 1 1 1 1 1 1 1 ··· 1 1 |
| | | WHITE 3 | ··· | ··· | 1 1 1 1 1 1 1 1 1 1 ··· 1 1 |
| | | WHITE 4 | ··· | ··· | 1 1 1 1 1 1 1 1 1 1 ··· 1 1 |
| | | CYAN | ··· | ··· | 1 1 1 1 1 1 1 1 1 1 ··· 1 1 |
| | | MAGENTA | ··· | ··· | 1 1 1 1 1 1 1 1 1 1 ··· 1 1 |
| | | YELLOW | ··· | ··· | 1 1 1 1 1 1 1 1 1 1 ··· 1 1 |
| | | BLACK | ··· | ··· | 1 1 1 1 1 1 1 1 1 1 ··· 1 1 |
| | 2 | WHITE 1 | ··· | ··· | 1 1 1 1 1 1 1 1 1 1 ··· 1 1 |
| | | WHITE 2 | ··· | ··· | 1 1 1 1 1 1 1 1 1 1 ··· 1 1 |
| | | WHITE 3 | ··· | ··· | 1 1 1 1 1 1 1 1 1 1 ··· 1 1 |
| | | WHITE 4 | ··· | ··· | 1 1 1 1 1 1 1 1 1 1 ··· 1 1 |
| | | CYAN | ··· | ··· | 1 1 1 1 1 1 1 1 1 1 ··· 1 1 |
| | | MAGENTA | ··· | ··· | 1 1 1 1 1 1 1 1 1 1 ··· 1 1 |
| | | YELLOW | ··· | ··· | 1 1 1 1 1 1 1 1 1 1 ··· 1 1 |
| | | BLACK | ··· | ··· | 1 1 1 1 1 1 1 1 1 1 ··· 1 1 |
| | ⋮ | ⋮ | ⋮ | ⋮ | ⋮ |
| FOOTER INFORMATION | ··· | | | | |

FIG. 11

423

| HEAD TYPE | NOZZLE | POINTER |
|---|---|---|
| WHITE 1 | NOZZLE[1] | 1 |
| | NOZZLE[2] | 5 |
| | : | : |
| | NOZZLE[420] | 1677 |
| WHITE 2 | NOZZLE[1] | 1 |
| | NOZZLE[2] | 5 |
| | : | : |
| | NOZZLE[420] | 1677 |
| WHITE 3 | NOZZLE[1] | 1 |
| | NOZZLE[2] | 5 |
| | : | : |
| | NOZZLE[420] | 1677 |
| WHITE 4 | NOZZLE[1] | 1 |
| | NOZZLE[2] | 5 |
| | : | : |
| | NOZZLE[420] | 1677 |
| CYAN | NOZZLE[1] | 8766 |
| | NOZZLE[2] | 8770 |
| | : | : |
| | NOZZLE[420] | 10442 |
| MAGENTA | NOZZLE[1] | 8766 |
| | NOZZLE[2] | 8770 |
| | : | : |
| | NOZZLE[420] | 10442 |
| YELLOW | NOZZLE[1] | 8766 |
| | NOZZLE[2] | 8770 |
| | : | : |
| | NOZZLE[420] | 10442 |
| BLACK | NOZZLE[1] | 8766 |
| | NOZZLE[2] | 8770 |
| | : | : |
| | NOZZLE[420] | 10442 |

FIG. 15

411

| RESOLUTION | DENSITY INFORMATION | LF VALUE | | | |
|---|---|---|---|---|---|
| | | REMAINDER AFTER DIVIDING (Cnt - 1) BY 4 | | | |
| | | 1 | 2 | 3 | 0 |
| 1200dpi | 500% | 335 | 335 | 335 | 339 |
| | 600% | 279 | 279 | 279 | 283 |
| | NORMAL | 419 | 419 | 419 | 423 |

IMAGE FORMATION DEVICE

CROSS-REFERENCE TO RELATED APPLICATION

This application claims priority to Japanese Patent Application No. 2017-073139, filed on Mar. 31, 2017, the disclosure of which is herein incorporated by reference in its entirety.

BACKGROUND

The present disclosure relates to an image formation device.

An image formation device forms a pixel array configured by a plurality of ink dots aligned in a main scan direction, by ejecting ink from nozzles when a head provided with the nozzles is caused to move relative to a print medium in the main scan direction. The image formation device forms an image on the print medium by causing the head to move relative to the print medium in a sub scan direction, and forming a plurality of the pixel arrays in the sub scan direction.

A multi-pass method is known in which formation of a single pixel array is completed by a plurality of main scans. For example, a multi-pass method is known, which is a method to print each of the pixel arrays by causing different nozzles, among a plurality of nozzles provided in a head, to scan the same pixel array. In the multi-pass method, the image formation device can also perform printing at a density that is higher than a unit density, which is a maximum density of ink that can be ejected at one time from the nozzles. The image formation device performs the printing by causing the relative movement of a carriage in the main scan direction and the sub scan direction with respect to a cloth. The carriage has the same number of white ink nozzles and color ink nozzles aligned in the sub scan direction.

SUMMARY

When an image formation device of related art forms pixel arrays of white ink at a high density using a multi-pass method, a relative movement amount of a carriage in a sub scan direction is controlled such that the white ink is ejected in an overlapping manner on some of the pixel arrays. The carriage also includes nozzles for color inks. Thus, there is a possibility that some of the pixel arrays of the color inks are formed by the color inks being ejected in the overlapping manner. As a result, there is a possibility that unevenness in the density of a color ink image may occur.

Embodiments of the broad principles derived herein provide an image formation device that can suppress unevenness in the density of the color ink image.

The embodiments herein provide an image formation device includes: a plurality of first nozzles arranged in a sub scan direction and capable of ejecting a first ink; a plurality of second nozzles arranged in the sub scan direction and capable of ejecting a second ink; and a control portion which forms an image of a resolution R [dpi], by relatively moving the first nozzles and the second nozzles in a main scan direction with respect to a print medium and causing the first ink and/or the second ink to be ejected, and relatively moving the first nozzles and the second nozzles in the sub scan direction with respect to the print medium, on the basis of print data. Each of the first nozzles and the second nozzles are arranged at an interval D [in] in the sub scan direction. When printing of adjacent D×R pixels, which are a number D×R of pixels adjacent to each other in the sub scan direction, is performed by the first ink at a high density Ph [%] that is higher than a unit density Pu [%], which is a maximum density of the first ink able to be ejected at one time from the first nozzles that eject the first ink, the control portion performs ejection control with respect to a pixel array formed in the main scan direction corresponding to pixels that are scanned a plurality of times in the main scan direction within the adjacent D×R pixels, such that total densities of the second ink ejected onto each of the pixels in the pixel array by the plurality of times of scanning are, respectively, substantially the same as a maximum density of the second ink that is able to be ejected at one time from the second nozzles.

BRIEF DESCRIPTION OF THE DRAWINGS

Embodiments will be described below in detail with reference to the accompanying drawings in which:

FIG. 7 is a diagram showing print data;

FIG. 11 is a diagram showing a master pointer table;

FIG. 15 is a diagram showing an LF value table; and

DETAILED DESCRIPTION

Figure 1:
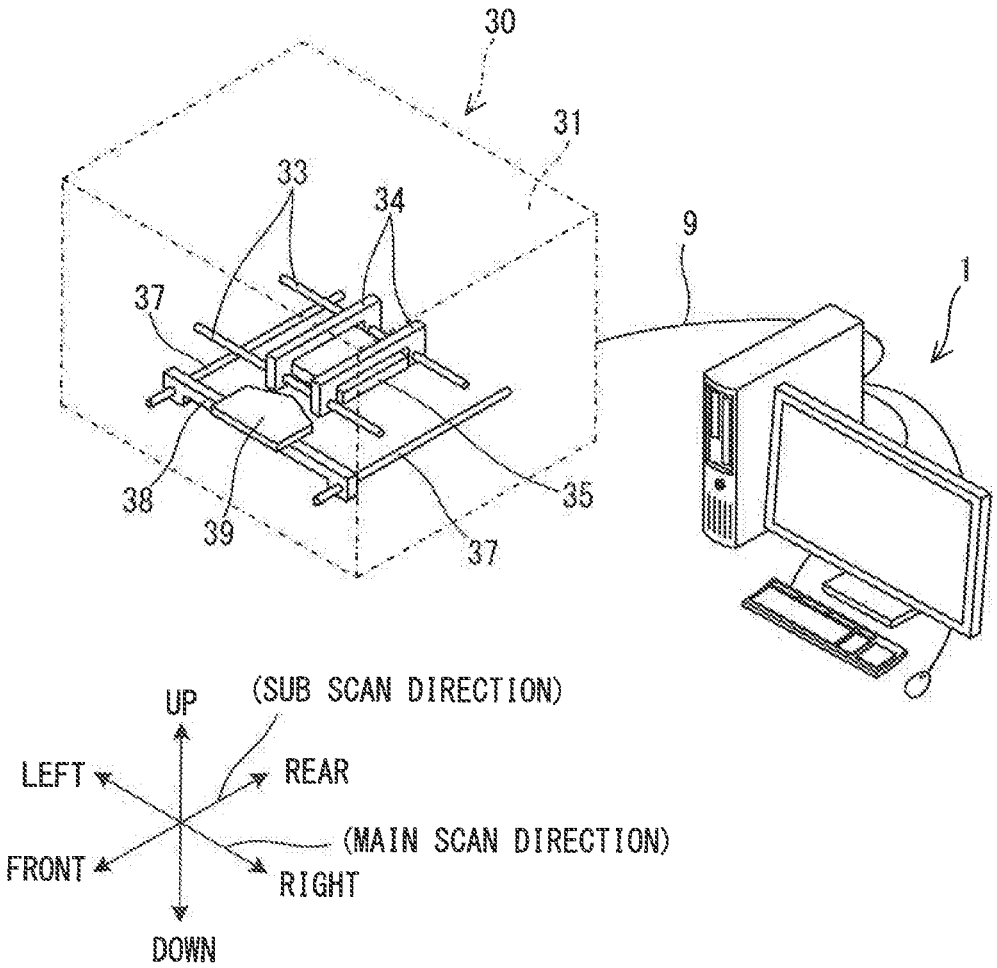
FIG. 1 is perspective view showing an outline configuration of a print device and a terminal device.

An embodiment of the present disclosure will be explained with reference to the drawings. A print device 30, which is an example of an image formation device, will be explained with reference to FIG. 1. The lower left side, the upper right side, the lower right side, the upper left side, the upper side and the lower side in FIG. 1 are, respectively, a front side, a rear side, a right side, a left side, an upper side, and a lower side of the print device 30.

Configuration of Print Device 30

The print device 30 is a known inkjet printer for use on cloth. The print device 30 prints an image on the cloth, which is a recording medium, by causing ejection heads 35 to perform scanning. A T-shirt or the like can be given as an example of the cloth. The print device 30 is connected to a terminal device 1, via a cable 9, for example. The terminal device 1 creates print data 421 in order to cause the print device 30 to perform print processing on the cloth. The print data 421 is transmitted from the terminal device 1 to the print device 30. The terminal device 1 is, for example, a personal computer (PC), a tablet, a high function mobile phone or the like.

A pair of guide rails 37 are provided in a lower portion inside a housing 31 of the print device 30. The pair of guide rails 37 extend in the front-rear direction. The pair of guide rails 37 support a platen support base 38 such that the platen support base 38 can move in the front-rear direction. A platen 39 is fixed to the platen support base 38, substantially in the center, in the left-right direction, of the top surface of the platen support base 38. The platen 39 is a plate body. The cloth is placed on the top surface of the platen 39. The platen support base 38 is conveyed in a sub scan direction by a sub-scan mechanism. The sub scan direction is the front-rear direction in which the cloth is conveyed by the platen 39. The sub-scan mechanism includes a sub-scan motor 47 (shown in FIG. 3), and a belt (not shown in the drawings).

Figure 2:
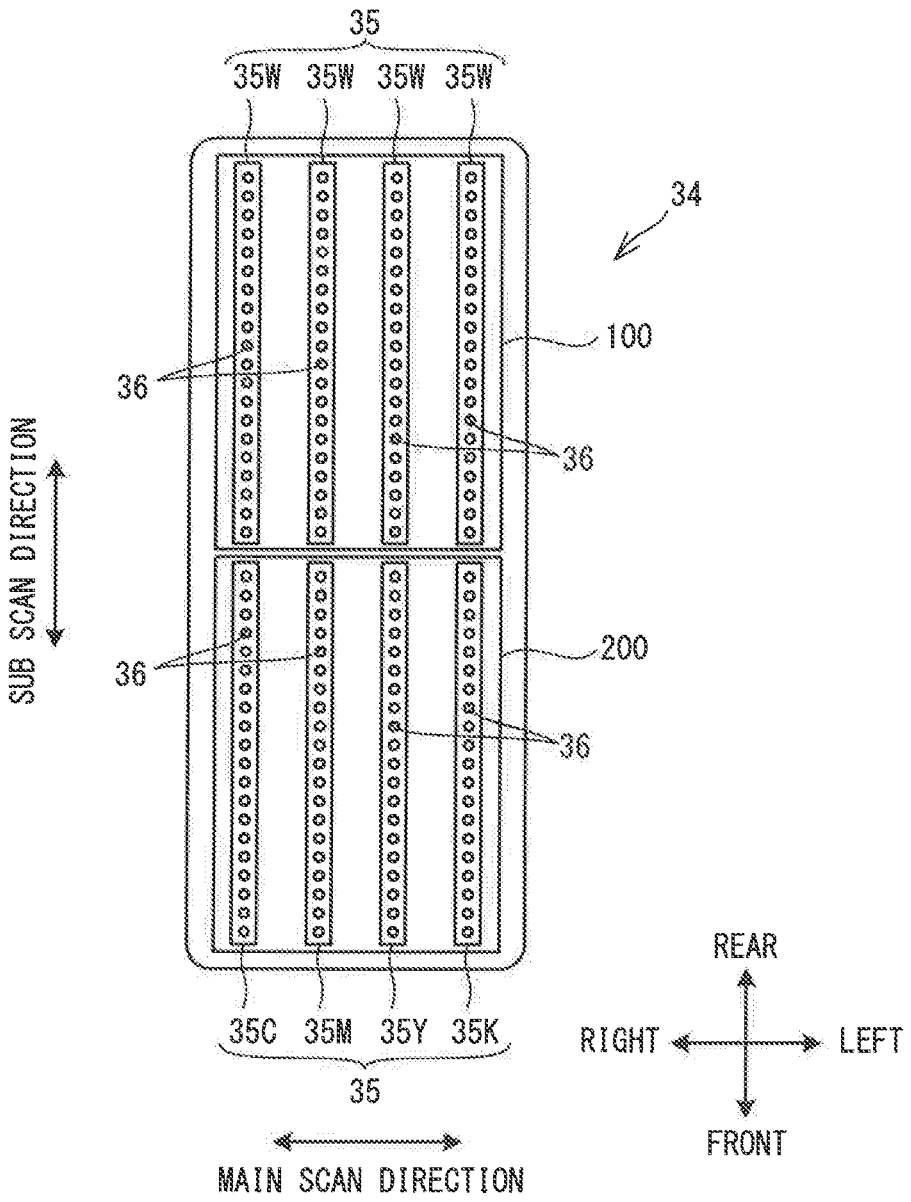
FIG. 2 is a bottom view showing an outline configuration of a carriage.

The print device 30 is provided with a pair of guide rails 33, inside the housing 31 and above the platen 39. The pair of guide rails 33 extend in the left-right direction. The pair of guide rails 33 support a carriage 34 such that the carriage 34 can move in the left-right direction. In an example shown in FIG. 2, a head unit 100 that is provided with four ejection heads 35W, and a head unit 200 that is provided with ejection heads 35C, 35M, 35Y, and 35K are mounted on the carriage 34. The carriage 34 is conveyed in a main scan direction, which is orthogonal to the sub scan direction, by a main scan mechanism. The main scan direction is the left-right direction in which the four ejection heads 35W, and the ejection heads 35C, 35M, 35Y, and 35K are conveyed by the carriage 34. The main scan mechanism includes a main scan motor 46 (shown in FIG. 3) and a belt (not shown in the drawings). In the following explanation, the four ejection heads 35W, and the ejection heads 35C, 35M, 35Y, and 35K are also referred to as the ejection heads 35. As shown in FIG. 2, a plurality of nozzles 36 are provided on a bottom surface of each of the ejection heads 35. The number of the plurality of nozzles 36 is, for example, 420. The 420 of the nozzles 36 are provided on each of the total of eight ejection heads 35. In FIG. 2, for simplification, a smaller number (namely, 20) of the nozzles 36 are shown than the actual number.

Figure 4:
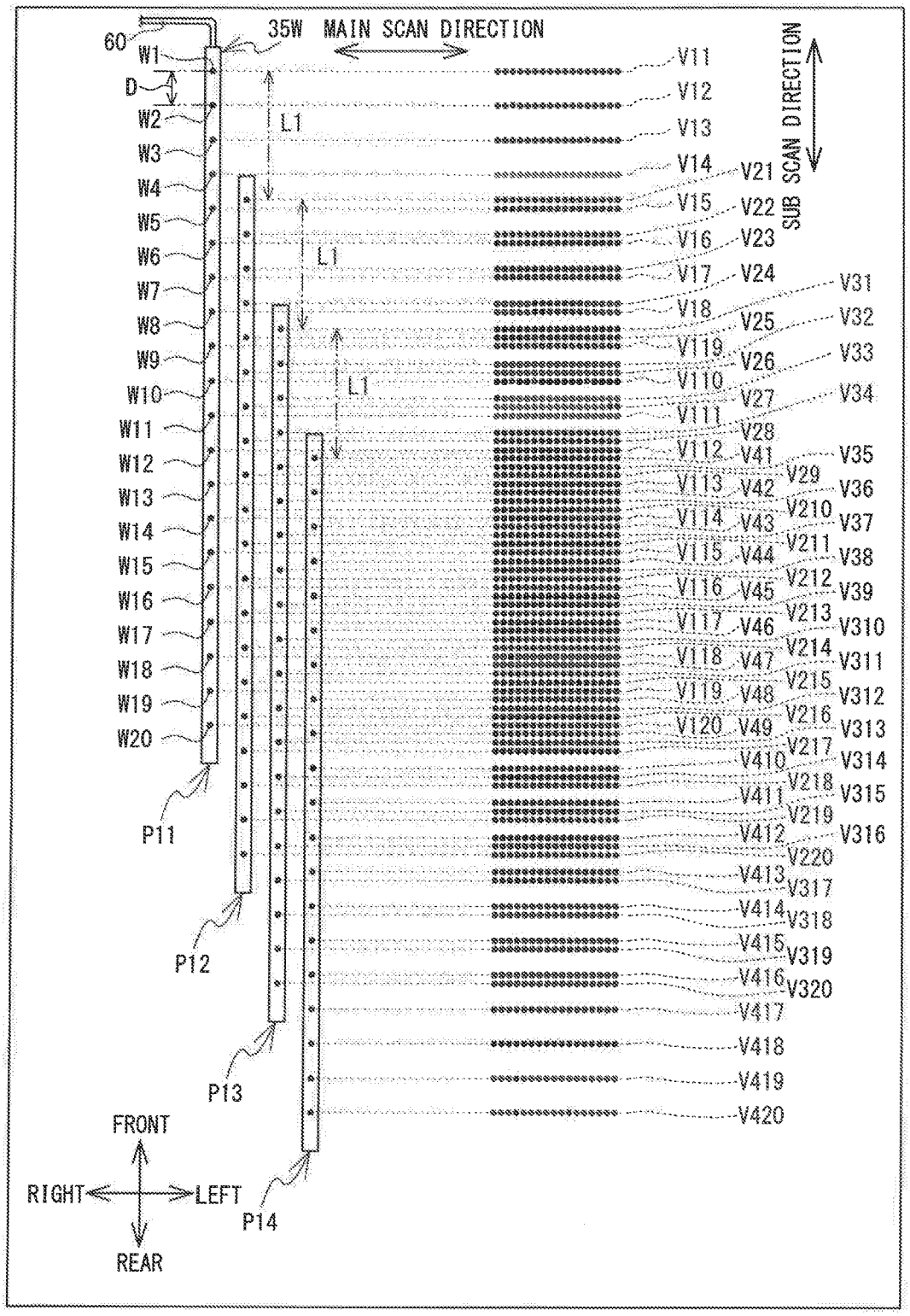
FIG. 4 is a diagram showing a process for forming a white ink image using an ejection head.
Figure 5:
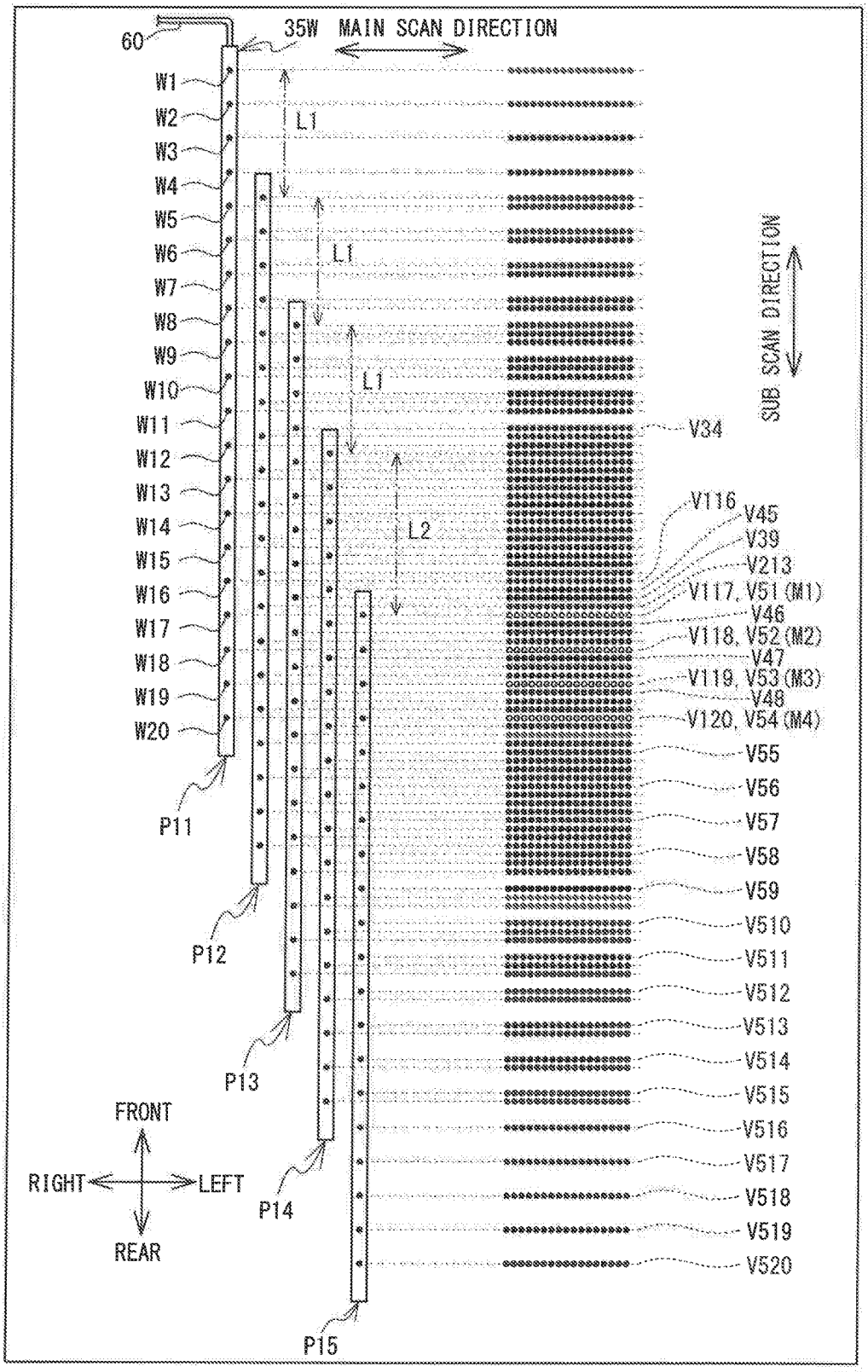
FIG. 5 is a diagram showing a process for forming a white ink image using an ejection head.

Each of the nozzles 36 can eject ink. Each of the nozzles 36 is arranged at an equal interval in the sub scan direction on the respective ejection heads 35. Ink of an ink cartridge mounted in the print device 30 is supplied from the front side of the carriage 34, for example. In the present embodiment, as shown in FIG. 4 and FIG. 5, an ink supply path 60 is connected to the front side of the ejection head 35W, and the ink is supplied to each of the nozzles 36. Although not described in detail here, the ink supplied to each of the nozzles 36 is ejected downward from each of the nozzles 36, by driving of a piezoelectric element or a heating element provided in each of the nozzles 36.

As shown in FIG. 2, the four ejection heads 35W of the head unit 100 are mounted on the carriage 34 such that the four ejection heads 35W are arranged in the main scan direction. A layout orientation of each of the nozzles 36 of the four ejection heads 35W is along the sub scan direction. The four ejection heads 35W eject white ink from each of the nozzles 36. In the present embodiment, the white ink is an ink used for a background. The ejection heads 35C, 35M, 35Y, and 35K of the head unit 200 are mounted on the carriage 34 such that the ejection heads 35C, 35M, 35Y, and 35K are arranged in the main scan direction. A layout orientation of each of the nozzles 36 of the ejection heads 35C, 35M, 35Y, and 35K is along the sub scan direction. The ejection heads 35C, 35M, 35Y, and 35K eject color inks from each of the nozzles 36. The ejection head 35C ejects cyan ink from the nozzles 36. The ejection head 35M ejects magenta ink from the nozzles 36. The ejection head 35Y ejects yellow ink from the nozzles 36. The ejection head 35K ejects black ink from the nozzles 36.

The print device 30 forms a predetermined number of pixel arrays in the main scan direction by ejecting ink while causing the ejection heads 35 to scan in the main scan direction. The predetermined number of pixel arrays extend in the left-right direction. When the print device 30 completes the formation of the predetermined number of pixel arrays by one main scan, the print device 30 moves the platen 39 in the sub scan direction and once more forms the predetermined number of pixel arrays by the main scan. The print device 30 forms a plurality of the pixel arrays by repeatedly performing the above-described operations in accordance with the print data 421. As a result, the print device 30 forms, on the cloth, an image in which the plurality of pixel arrays are arranged in the sub scan direction.

Electrical Configuration

An electrical configuration of the print device 30 will be explained with reference to FIG. 3. The print device 30 is provided with a central processing unit (CPU) 40 that controls the print device 30. A read only memory (ROM) 41, a random access memory (RAM) 42, an application specific integrated circuit (ASIC) 43, a head drive portion 44, a motor drive portion 45, a display control portion 48, an operation processing portion 50, and a universal serial bus (USB) interface 52 are connected to the CPU 40 via a bus 55.

The ROM 41 stores a main program that controls operations of the print device 30, initial values, and the like. Further, the ROM 41 stores a line feed (LF) value table 411 (to be described later) shown in FIG. 15. The RAM 42 temporarily stores various data. The ASIC 43 controls the head drive portion 44, and the motor drive portion 45. The head drive portion 44 is connected to the ejection heads 35 that eject the ink. The head drive portion 44 drives the piezoelectric element or the heating element provided in each of the nozzles 36 of the ejection heads 35. The motor drive portion 45 drives the main scan motor 46 and the sub-scan motor 47. The main scan motor 46 moves the carriage 34 in the main scan direction. The sub-scan motor 47 moves the platen 39 in the sub scan direction. The display control portion 48 controls display of a display 49 in accordance with an instruction from the CPU 40. Various screens, messages, and the like relating to the operation of the print device 30, are displayed on the display 49. The operation processing portion 50 receives the input of an operation with respect to an operation panel 51. A user can input various pieces of information and instructions via the operation panel 51. The USB interface 52 connects the print device 30 to an external device, such as the terminal device 1. Note that, in place of the USB interface 52, the print device 30 may be provided with serial interface of another standard, and may be connected to the external device, such as the terminal device 1, via a serial cable of that standard. Further, the print device 30 may be provided with a wired and/or wireless communication module, and may be connected to the external device, such as the terminal device 1, via various types of network, such as the Internet, an intranet or the like.

Storage Areas of RAM 42

Figure 16:
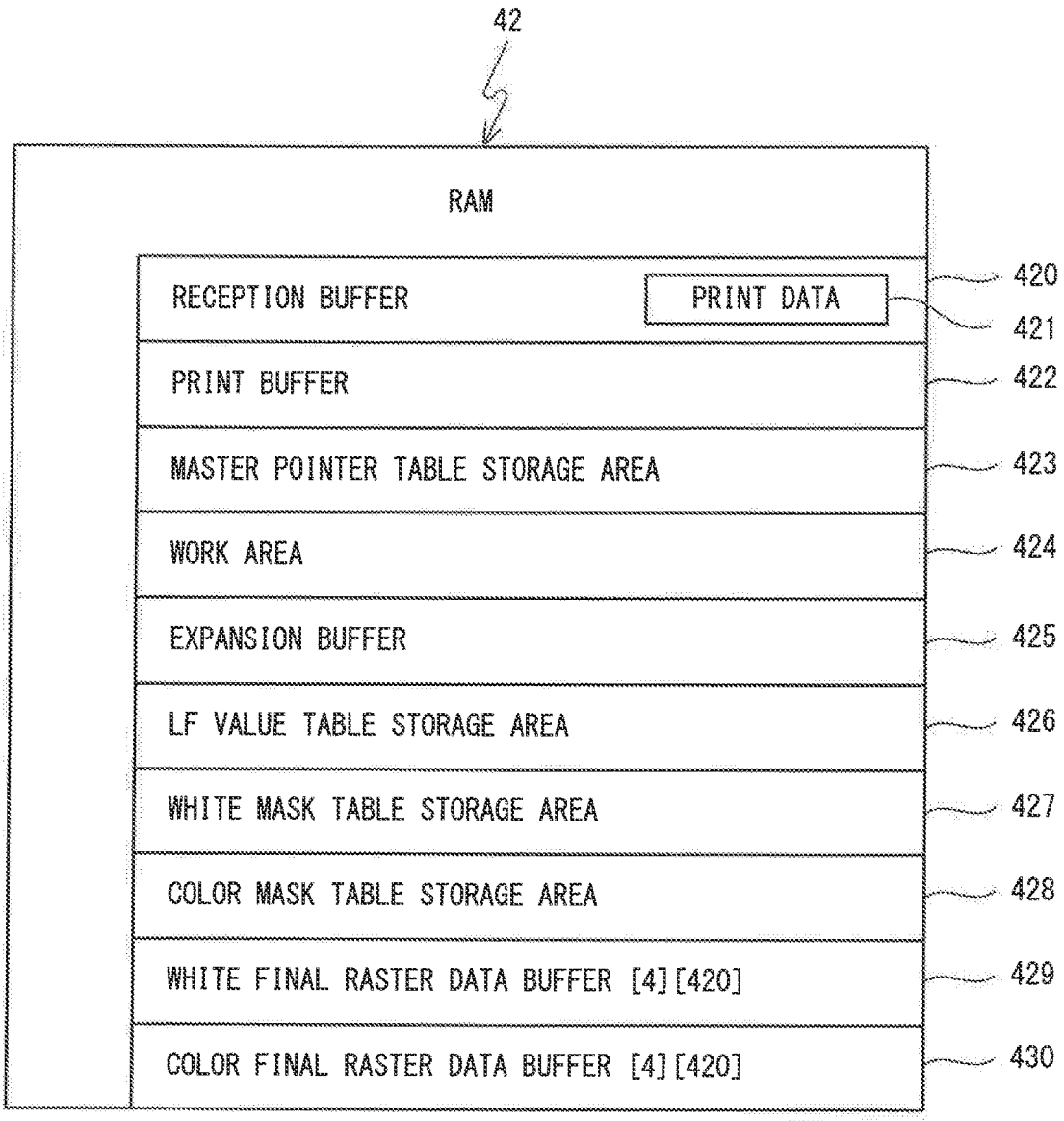
FIG. 16 is a conceptual diagram showing storage areas of a RAM.

Storage areas of the RAM 42 will be explained with reference to FIG. 16. The storage areas of the RAM 42 include a reception buffer 420, a print buffer 422, a master pointer table storage area 423, a work area 424, an expansion buffer 425, an LF table storage area 426, a white mask table storage area 427, a color mask table storage area 428, a white final raster data buffer 429, and a color final raster data buffer 430. The reception buffer 420 stores the print data 421 to be described later. The print buffer 422 and the master pointer table storage area 423 will be described later. The work area 424 temporarily stores various data. The expansion buffer 425 stores raster data expanded by processing at step S14 to be described later. The LF value table storage area 426 stores a high density LF value table and a normal LF value table set at steps S153 and S154 to be described later. The white mask table storage area 427 stores a white mask table set at step S103 to be described later. The color mask table storage area 428 stores a color mask table set at step S109 to be described later. The white final raster data buffer 429 stores white final raster data calculated at step S105 to be described later. The color final raster data buffer 430 stores color final raster data calculated at step S111 to be described later.

Overview of Operations of Print Device 30

An overview of operations of the print device 30 will be explained with reference to FIG. 4 and FIG. 5. FIG. 4 and FIG. 5 show a state in which the ejection heads 35W that eject the white ink move relatively in the sub scan direction, by the platen 39 moving in the sub scan direction. Below, for ease of explanation, the movement of the platen 39 in the sub scan direction will be re-phrased as "the ejection heads 35 are moved relatively in the sub scan direction." Further, unless otherwise particularly specified, "the ejection heads 35 are moved relatively in the sub scan direction" indicates that "the ejection heads 35 move relatively toward the rear." In this case, in actuality, the platen 39 moves toward the front with respect to the carriage 34 on which the ejection heads 35 are mounted.

In FIG. 4, for ease of explanation, the number of the nozzles 36 included in each of the ejection heads 35 is twenty, which is a smaller number than the 420 nozzles 36 in one row. In FIG. 4, of the four ejection heads 35W of the head unit 100 that eject the white ink, an overview of the operation of one of the ejection heads 35W will be explained. The twenty nozzles 36 of the ejection head 35W are respectively referred to as nozzles W1, W2, W3, W4, W5, W6, W7, W8, W9, W10, W11, W12, W13, W14, W15, W16, W17, W18, W19, and W20 in order from the front side. Although not limited to this example, the distance between each of the twenty nozzles 36 is 1/300 (in), and is denoted by "D." Although not limited to this example, it is here assumed that a resolution of an image formed by the ejection heads 35 is "1200 (dpi) (main scan direction)×1200 (dpi) (sub scan direction)." The resolution in both directions of "1200 (dpi)" is denoted by "R." In FIG. 4, a number of ink ejection points (hereinafter referred to as "dots" or pixels) included in a single pixel array in the main scan direction is "16." Note that, when R=1200 (dpi) and D=1/300 (in), four dots (D/(1/R)=D×R) are formed in the distance D between the adjacent nozzles 36 in the sub scan direction. Thus, the four dots are formed at a 1/R interval in the distance D in the sub scan direction. Below, the adjacent D×R (number of) pixels in the sub scan direction are referred to as "adjacent D×R pixels." In the present specific example, since D×R=(1/300)×1200=4 dots, hereinafter, the "adjacent D×R pixels" are also referred to as "adjacent four pixels." Of a range in which the carriage 34 can move in the main scan direction, a position furthermost to the right side is referred to as an "initial position." The ejection heads 35C, 35M, 35Y, and 35K of the head unit 200 are configured in the same manner as the ejection heads 35W.

Formation of White Ink Image

With reference to FIG. 4 and FIG. 5, an operation will be explained for a case in which an image of white ink (hereinafter referred to as a "white ink image") is formed. A density of a single pixel by a maximum droplet amount of the white ink that can be ejected in one pass by the nozzles W is assumed to be 100(%). When printing has been performed at 100(%) density for all the pixels configuring the adjacent four pixels, the total density of the adjacent four pixels is 400(%). Below, the total density of 400(%) of the adjacent four pixels is referred to as "unit density Pu (%)." In other words, in the case of the adjacent D×R pixels, the unit density Pu (%)=(D×R)×100(%). There is a case in which a print density of the adjacent four pixels specified by the print data 421 that will be described later is specified as a higher density than the unit density Pu (%). The density that is higher than the unit density Pu (%) is referred to as a "high density Ph (%)." Below, the high density Ph (%) is 500(%), for example. In the following example, the CPU 40 controls the nozzles W1 to W20 so as to respectively eject the maximum droplet amount of the white ink that can be ejected in the one pass, in processes P11 to P15 that will be described later.

As shown in FIG. 4, in order to form the white ink image at the resolution R (dpi) using the single ejection head 35W, the CPU 40 causes the white ink to be ejected onto the cloth from the nozzles W1 to W20 (the process P11). Next, the CPU 40 moves the ejection head 35W by 1/R in the main scan direction. The CPU 40 repeats the movement of the ejection head 35W in the main scan direction and the ejection of the white ink 15 times. Therefore, using the single ejection head 35W, the print device 30 forms, on the cloth, twenty pixel arrays, in each of which the sixteen dots are arranged in the main scan direction at 1/R intervals. Below, the twenty pixel arrays formed, respectively, by the nozzles W1 to W20 in the process P11 are respectively referred to as pixel arrays V11 to V120. The pixel arrays V11 to V120 are arranged on the cloth at intervals of the distance D in the sub scan direction.

Next, the CPU 40 relatively moves the ejection head 35W in the sub scan direction from a position in the process P11, by ((N/(Ph/Pu))+n1k)×1/R (note that n1k is an integer other than "0" of an absolute value |n1k|≤(D×R−1), where k=1, 2, . . . , (D×R−1) and where combinations of remainders obtained by dividing {n11, n11+n12, n11+n12+n13, . . . Σn1k (k=1, 2, . . . , (D×R−1))} by (D×R), satisfy the condition {0, 1, 2, 3, . . . , (D×R−1)}). Below, a distance of the relative movement in the sub scan direction ((N/(Ph/Pu))+n1k)×1/R is denoted as "L1k." N indicates a number of the nozzles 36 of the ejection head 35. Below, as an example, n1k=−1 (k=1, 2, . . . , (D×R−1)). The reason why n1k is a given natural number other than "0" of the absolute value |n1k|≤(D×R−1), and the combinations of remainders obtained by dividing {n11, n11+n12, n11+n12+n13, . . . Σn1k (k=1, 2, . . . , (D×R−1)} by D×R, are caused to satisfy the condition {0, 1, 2, 3, . . . , (D×R−1)} will be explained later.

In the present specific example, n11=n12=n13=−1, N=20, Pu=400, Ph=500, and R=1200. Thus $$L11 = L12 = L13 = ((20/(500/400)) - 1) \times 1/1200$$

$$= ((20/1.25) - 1) \times 1/1200$$

-continued $$= (16-1)\times 1/1200$$

$$= 15\times 1/1200.$$

Thus, L11=L12=L13=15/1200 (in).

In the present specific example, L11, L12, L13 are the same value, and are thus simply denoted as L1 below.

Next, the CPU 40 moves the ejection head 35W in the main scan direction. The CPU 40 causes the white ink to be ejected onto the cloth from the nozzles W1 to W20, at intervals of 1/R in the main scan direction (the process P12). Below, the twenty pixel arrays formed by each of the nozzles W1 to W20 in the process P12 are referred to as pixel arrays V21 to V220. The pixel arrays V21 to V220 are respectively formed to the rear of each of the pixel arrays V11 to V120 formed in the process P11, by an amount corresponding to L1.

Next, the CPU 40 relatively moves the ejection head 35W in the sub scan direction from the position in the process P12, by the amount corresponding to L1, and then moves the ejection head 35W in the main scan direction and causes the white ink to be ejected onto the cloth from the nozzles W1 to W20 (the process P13). Below, the twenty pixel arrays formed by each of the nozzles W1 to W20 in the process P13 are referred to as pixel arrays V31 to V320. The pixel arrays V31 to V320 are respectively formed to the rear of each of the pixel arrays V21 to V220 formed in the process P12, by the amount corresponding to L1.

Next, the CPU 40 relatively moves the ejection head 35W in the sub scan direction from the position in the process P13, by the amount corresponding to L1, and then moves the ejection head 35W in the main scan direction and causes the white ink to be ejected onto the cloth from the nozzles W1 to W20 (the process P14). Below, the twenty pixel arrays formed by each of the nozzles W1 to W20 in the process P14 are referred to as pixel arrays V41 to V420. The pixel arrays V41 to V420 are respectively formed to the rear of each of the pixel arrays V31 to V320 formed in the process P13, by the amount corresponding to L1.

As a result of the processes P12 to P14, 38 pixel arrays are formed in the sub scan direction at intervals of 1/R, in a section between the pixel array V34 and the pixel array V217. Thus, the section from the pixel array V34 to the pixel array V217 has the resolution R, and the white ink dots are arranged in a lattice formation at the intervals of 1/R in the main scan direction and the sub scan direction. In the present specific example, in this way, the adjacent four pixels are formed with the resolution 1200 (dpi). Thus, in order to form the adjacent D×R pixels with the resolution R (dpi), the relative movement of the ejection head 35W in the sub scan direction by the amount L1k (k=1, 2, . . . , (D×R−1)), and the main scanning of the ejection head 35W for ((D/(1/R))−1)=(D×R−1) number of times are repeated. In other words, in the present specific example, the above-described operations are repeated (1/300)×1200−1=3 times.

Next, as shown in FIG. 5, the CPU 40 relatively moves the ejection head 35W in the sub scan direction from the position in the process P14 by ((N/(Ph/Pu))+n2+m)×1/R (note that n2 is a number obtained through code conversion of Σn1k (k=1, 2, 3, . . . , (D×R−1)), and m is an integer of 0≤m≤(D×R−1)). In the present specific example, the movement in the sub scan direction of the ejection head 35W by the amount L1 is repeated three times, and, since n11=n12=n13=−1, n2=3. Further, in the present specific example, an explanation will be made in which m=0. "m" is a constant that determines whether or not, among the adjacent D×R pixels, the density of any of the pixel arrays is to be increased. For example, when m=0, the density of the pixel array corresponding to the front-most pixel of the adjacent D×R pixels is high and is 200%. Below, the relative movement distance in the sub scan direction ((N/(Ph/Pu))+n2+m)×1/R is denoted as "L2." In the case of the present specific example, N=20, Pu=400, Ph=500, R=1200, n2=3, and m=0. Thus:

$$L2 = ((20/(500/400))+3)\times 1/1200$$

$$= ((20/1.25)+3)\times 1/1200$$

$$= (16+3)\times 1/1200$$

$$= 19\times 1/1200$$

$$= 19/1200.$$

Accordingly, L2=19/1200 (in).

Next, the CPU 40 moves the ejection head 35W in the main scan direction. The CPU 40 causes the white ink to be ejected onto the cloth from the nozzles W1 to W20 at the intervals of 1/R in the main scan direction (the process P15). Below, the twenty pixel arrays formed by each of the nozzles W1 to W20 in the process P15 are referred to as pixel arrays V51 to V520. The pixel arrays V51 to V520 are respectively formed to the rear of each of the pixel arrays V41 to V420 formed in the process P14, by an amount corresponding to L2.

In the present specific example, in the process P15, a position of the nozzle W1 of the ejection head 35W in the sub scan direction matches a position of the nozzle W17 of the ejection head 35W in the process P11. Thus, the pixel array V51 is formed in the position of the pixel array V117 formed in the process P11. In other words, a single one of the pixel arrays (hereinafter referred to as a "pixel array M1") is formed by the dots included in the pixel arrays V117 and V51. Similarly, the pixel array V52 is formed in the position of the pixel array V118, the pixel array V53 is formed in the position of the pixel array V119, and the pixel array V54 is formed in the position of the pixel array V120. A single one of the pixel arrays (hereinafter referred to as a "pixel array M2") is formed by the dots included in the pixel arrays V118 and V52, a single one of the pixel arrays (hereinafter referred to as a "pixel array M3") is formed by the dots included in the pixel arrays V119 and V53, and a single one of the pixel arrays (hereinafter referred to as a "pixel array M4") is formed by the dots included in the pixel arrays V120 and V54. As described above, the method of forming the single pixel array by causing the different nozzles 36 to scan the same position is generally called the "multi-path method" or "singling" or the like.

n1k and n2 n1k is an integer other than "0" of the absolute value |n1k|≤3, and in the above-described specific example, as an example, n1k=−1 (k=1, 2, . . . , (D×R−1)). The reason for this is that the adjacent D×R pixels are formed in the sub scan direction by performing the relative movement of L1k of the ejection head 35W in the sub scan direction (D×R−1) times. Further, the reason for making n2 the number obtained through code conversion of the sum Σn1k of n1k is in order to eject the white ink from the nozzles 36 so as to overlap with the front-most pixel within the adjacent D×R pixels. Thus, if m is a value other than "0," the white ink can be ejected from the nozzles 36 so as to overlap with the pixels other than the front-most pixel within the adjacent D×R pixels. Note that, in the present specific example, when the adjacent four pixels in the sub scan direction are printed at a high density Ph (%) (500%, for example), the L1 movement is performed three times and the L2 movement is performed one time. In the case of the high density Ph (%), the number of L2 movements is round [{(R×D−1)+(Ph−Pu)/100}/(D×R)] times. "round" is a function to round off after the decimal point. For example, round (1.23)=1. The combinations of "n11, n12, n13, n2" of the present specific example are "−1, −1, −1, 3," "−1, −2, 1, 2," "−2, 1, −2, 3," "−2, −1, 2, 1," "−3, 2, −1, 2," "−3, 1, 1, 1," and so on.

In the pixel array M1, the pixel array V52 is printed at the print density of 100(%) on top of the pixel array V117 printed at the print density of 100(%). Thus, the print density of the pixel array M1 is 200(%). In the pixel arrays of the adjacent four pixels of the pixel arrays V45, V39, V213, and M1, the print densities of the pixel arrays V45, V39, and V213 are 100(%), respectively. Thus, the total density of the pixel arrays V45, V39, V213, and M1 is 500(%). Similarly, for the pixel arrays of the adjacent four pixels of the pixel arrays V46 to M2, the pixel arrays of the adjacent four pixels of the pixel arrays V47 to M3, and the pixel arrays of the adjacent four pixels of the pixel arrays V48 to M4, the total print density is 500(%) in each case.

As described above, by the white ink being ejected from the ejection head 35W in the processes P11 to P15, the pixel arrays including the sixteen dots of white ink aligned in the main scan direction are arranged in the sub scan direction. In addition, the print device 30 can use the "multi-pass method" to eject the ink by causing the ejection head 35W to scan in the main scan direction five times, and can thus print the pixel arrays of the adjacent four pixels at the high density Ph (%) of 500(%). As shown in FIG. 4, in order to print the pixel arrays of the adjacent four pixels at the total density of 400(%), the print device 30 performs the print processing from the process P11 to the process P14 four times. Further, as shown in FIG. 5, in order to print the pixel arrays of the adjacent four pixels at the total density of 500(%), the print device 30 performs the print processing from the process P11 to the process P15 five times. As a result, the print time for the high density Ph (%) of 500(%) is five fourths the print time for 400(%). In a printing method of the high density Ph (%) in related art, for example, in order to print four pixels that are adjacent in the sub scan direction at the density of 500(%), the print device 30 performs the relative movement control of an ejection head in the sub scan direction as described above eight times. Further, in the multi-pass method, when the four pixels that are adjacent in the sub scan direction are printed at the density of 500(%) and printing at half the density of the high density Ph (%) is performed a second time overlapping with respect to the same pixel array, since the scan is performed twice on the same pixel array, twice as much time is taken as in a single path method in which the main scan of the same pixel array is only performed once. Thus, in the present embodiment, the print time of the high density Ph (%) can be shortened.

The operations of one of the four ejection heads 35W are explained above. In actuality, as shown in FIG. 2, the four ejection heads 35W are mounted on the carriage 34 in a state of being arranged in the main scan direction. Each of the ejection heads 35W ejects the white ink from the nozzles W1 to W20 while moving in the main scan direction, and thus forms the twenty pixel arrays. The positions of the twenty pixel arrays formed by the nozzles W1 to W20 of each of the ejection heads 35W match each other in the sub scan direction. Thus, each of the pixel arrays formed by the nozzles W1 to W20 of each of the ejection heads 35W is formed as a single pixel array as a result of the pixel arrays formed by each of the four ejection heads 35W being overlaid on each other.

By using the above-described method, simply by causing the ejection heads 35W to move relatively in the sub scan direction {(R×D−1)+(Ph−Pu)/100} times, the printing at the high density Ph (%) can be performed. In the above-described specific example, (1200/300−1)+(500−400)/100=4 times.

Formation of Color Ink Image

Next, with reference to FIG. 6, a case will be explained in which, at the same time that the white ink image is formed by the ejection heads 35W moving relatively in the sub scan direction as shown in FIG. 4 and FIG. 5, an image including cyan ink (hereinafter referred to as a "cyan ink image") is formed by the ejection head 35C. The ejection heads 35C and 35W are all mounted on the carriage 34 and thus, the ejection head 35C moves in conjunction with the ejection heads 35W. Processes P21 to P25 shown in FIG. 6 correspond, respectively, to processes P11 to P15 shown in FIG. 5. Operations when an image including the other color inks (hereinafter referred to as a "color ink image") is formed by the ejection heads 35M, 35Y, and 35K are the same as those when the cyan ink image is formed by the ejection head 35C.

The CPU 40 moves the ejection head 35C in the main scan direction. At a timing at which the white ink is ejected in the process P21 shown in FIG. 5, the CPU 40 causes the cyan ink to be ejected onto the cloth from nozzles C1 to C20 (the process P21). In this way, the CPU 40 forms, on the cloth, twenty pixel arrays in which 16 dots are arranged in the main scan direction. Below, the twenty pixel arrays formed by each of the nozzles C1 to C20 in the process P21 are respectively referred to as pixel arrays U11, U12, U13, U14, U15, U16, U17, U18, U19, U110, U111, U112, U113, U114, U115, U116, U117, U118, U119, and U120. The pixel arrays U11 to U120 are arranged on the cloth at intervals of the distance D in the sub scan direction.

Next, the CPU 40 relatively moves the ejection head 35C in the sub scan direction by an amount corresponding to L1. After that, the CPU 40 moves the ejection head 35C in the main scan direction. At a timing at which the white ink is ejected, the CPU 40 causes the cyan ink to be ejected onto the cloth from the nozzles C1 to C20 (the process P22). Below, twenty pixel arrays formed by each of the nozzles C1 to C20 in the process P22 are respectively referred to as pixel arrays U21, U22, U23, U24, U25, U26, U27, U28, U29, U210, U211, U212, U213, U214, U215, U216, U217, U218, U219, and U220. In FIG. 6, since the drawing becomes complex, these reference signs are partially omitted. Each of the pixel arrays U21 to U220 are formed in positions to the rear of each of the pixel arrays U12 to U120 formed in the process P21, by the amount corresponding to L1.

Next, the CPU 40 relatively moves the ejection head 35C in the sub scan direction from a position in the process P22, by the amount corresponding to L1, then moves the ejection head 35C in the main scan direction and causes the cyan ink to be ejected onto the cloth from the nozzles C1 to C20 (the process P23). Below, twenty pixel arrays formed by each of the nozzles C1 to C20 in the process P23 are respectively referred to as pixel arrays U31 to U320. Each of the pixel arrays U31 to U320 are formed to the rear of each of the pixel arrays U21 to U220 formed in the process P22, by the amount corresponding to L1.

Next, the CPU 40 relatively moves the ejection head 35C from a position in the process P23 in the sub scan direction by the amount corresponding to L1, and then moves the ejection head 35C in the main scan direction and causes the cyan ink to be ejected onto the cloth from the nozzles C1 to C20 (the process P24). Below, twenty pixel arrays formed by each of the nozzles C1 to C20 in the process P24 are respectively referred to as pixel arrays U41 to U420. Each of the pixel arrays U41 to U420 are formed to the rear of each of the pixel arrays U31 to U320 formed in the process P23, by the amount corresponding to L1.

Next, the CPU 40 relatively moves the ejection head 35C, by an amount corresponding to L2, in the sub scan direction, from a position of the ejection head 35C in the process P24, and moves the ejection head 35C in the main scan direction. The print device 30 causes the cyan ink to be ejected onto the cloth from the nozzles C1 to C20 at intervals of 1/R in the main scan direction (the process P25). Below, twenty pixel arrays formed by each of the nozzles C1 to C20 in the process P25 are referred to as pixel arrays U51 to U520. Each of the pixel arrays U51 to U520 are formed to the rear of each of the pixel arrays U41 to U420 formed in the process P24, by the amount corresponding to L2.

In the present specific example, the position of the nozzle C1 of the ejection head 35C in the sub scan direction in the process P25 matches the position of the nozzle C17 of the ejection head 35C in the process P21. Thus, the pixel array U51 is formed in the position of the pixel array U117 formed in the process P21. Specifically, a single one of the pixel arrays (hereinafter referred to as a "pixel array M11") is formed by the dots included in the pixel arrays U117 and U51. Similarly, the pixel array U52 is formed in the position of the pixel array U118, the pixel array U53 is formed in the position of the pixel array U119, and the pixel array U54 is formed in the position of the pixel array U120. A single one of the pixel arrays (hereinafter referred to as a "pixel array M12") is formed by the dots included in the pixel arrays U118 and U52, a single one of the pixel arrays (hereinafter referred to as a "pixel array M13") is formed by the dots included in the pixel arrays U119 and U53, and a single one of the pixel arrays (hereinafter referred to as a "pixel array M14") is formed by the dots included in the pixel arrays U120 and U54.

The CPU 40 ensures that, of the pixel array M11, the position in the main scan direction of the cyan ink ejected from the nozzle C17 in the process P21 does not overlap with the position in the main scan direction of the cyan ink ejected from the nozzle C1 in the process P25. More specifically, when forming the pixel array M11, the print device 30 forms the dots by the nozzle C1 in the process P25 in positions different to the positions of the dots formed by the nozzle C17 in the process P21, such that a sum of the number of dots formed in the process P21 and the number of dots formed in the process P25 is "16." Thus, a density difference between the pixel array M11 formed by the multi-pass method and the other pixel arrays is suppressed. When forming the pixel array M12 also, the CPU 40 causes the cyan ink to be ejected from the nozzles C18 and C2 using the same method. Further, when forming the pixel array M13 also, the CPU 40 causes the cyan ink to be ejected from the nozzles C19 and C3 using the same method. In addition, when forming the pixel array M14 also, the CPU 40 causes the cyan ink to be ejected from the nozzles C20 and C4 using the same method. As a result, the density difference between the pixel arrays M11 to M14 and the other pixel arrays is suppressed.

As described above, the print device 30 controls the amount of the relative movement in the sub scan direction of the ejection heads 35W so that the high density white ink image is formed, and a print time can be reduced. Further, even when printing is performed using the multi-pass method, the print device 30 controls the ejection of the cyan ink from the ejection head 35C as described above, and can thus suppress unevenness in the density of the cyan ink image.

Print Data

The print data 421 will be explained with reference to FIG. 7. The print data 421 is transmitted to the print device 30 from the terminal device 1 shown in FIG. 1, via the cable 9, for example. When the CPU 40 of the print device 30 receives the print data 421 via the cable 9, the CPU 40 stores the received print data 421 in the reception buffer 420 of the RAM 42. Based on the received print data 421, the CPU 40 forms the white ink image and/or the color ink image on the cloth, by executing main processing shown in FIG. 8 to be described later.

The print data 421 includes header information, raster information, and footer information. The header information includes the resolution, density information, platen information, and print method specification information. The resolution indicates the resolution R (dpi) of the image to be printed. Below, it is assumed that the resolution R is "1200 (dpi)." An explanation is made in which an example of the distance D between each of the nozzles 36 is "1/300 (in)" and satisfies a relationship of R=4/D, and m=0. The density information indicates the density at which the white ink image is printed. The platen information indicates an area of the platen 39 supported by the platen support base 38, using coordinate information. The print method specification information indicates which of the following images is to be printed based on the print data 421: (1) only the white ink image is included; (2) only the color ink image is included; and (3) both the white ink image and the color ink image are included. In the present embodiment, the print method specification information indicates (2) only the color ink image is included, and (3) both the white ink image and the color ink image are included, and the color ink image is formed on the cloth.

The raster information includes pixel array numbers, color information, a left margin, a right margin, and raster data. The pixel array number indicates a number ("1," "2," "3," . . . ) that is assigned, in order from the front side, to each of a plurality of pixel arrays aligned at the interval of 1/R in the sub scan direction. In other words, each of the pixel array numbers indicates a position at which a corresponding pixel array is formed on the print medium.

The color information is information indicating the color of the ink used to form the pixel array of the corresponding pixel array number. As the color information, in the present specific example, white 1 to 4, cyan, magenta, yellow, and black are associated with the pixel array numbers. One of the pixel arrays is formed by the ink being ejected from the total of the eight ejection heads 35, namely, from the four ejection heads 35W (white 1 to 4), and the ejection heads 35C (cyan), 35M (magenta), 35Y (yellow), and 35K (black). As a result, as shown in FIG. 7, in the present specific example, the eight different pieces of color information (white 1 to 4, cyan, magenta, yellow, and black) are associated with each of the pixel array numbers.

The left margin and the right margin are associated with the raster data, and are pieces of information to identify positions of the platen 39, based on encoders (not shown in the drawings) provided on the guide rails 33. The left margin indicates a position of the left end of the pixel array corresponding to the pixel array number, using a distance from the left end of the platen 39. The right margin indicates a position of the right end of the pixel array corresponding to the pixel array number, using a distance from the right end of the platen 39.

The raster data indicates whether or not to eject the ink from the nozzle 36 to form the pixel array by the main scan. The raster data is bit information in which one of "1" and "0" is arranged. The bit "1" of the raster data indicates that the ink dot is to be ejected from the nozzle 36. The bit "0" of the raster data indicates that the ink dot is not to be ejected from the nozzle 36.

Print Buffer

Figure 10:
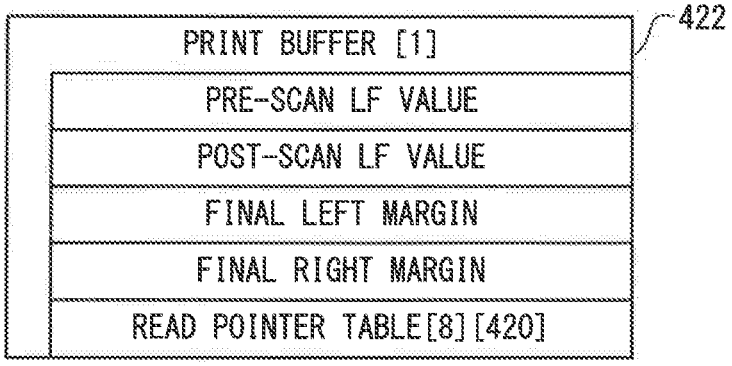
FIG. 10 is a diagram showing a print buffer [1]

The print buffer 422 will be explained with reference to FIG. 10. In the present embodiment, there are X (X=(R×D)+(Ph−Pu)/100) print buffers 422 in the RAM 42. In the following explanation, the number X of the print buffer 422 is represented as print buffer [X] 422. In FIG. 10, the print buffer [1] 422 is shown as an example of the print buffer [X] 422. A pre-scan LF value, a post-scan LF value, a final left margin, a final right margin, and a read pointer table [8] [420] are stored in the print buffer [1] 422. The pre-scan LF value, the post-scan LF value, the final left margin, and the final right margin will be explained later. 8×420 pointers included in a master pointer table 423 (to be described later) shown in FIG. 11 are stored in the read pointer table [8] [420]. As a result of initialization processing at step S1 in the main processing to be described later, the CPU 40 sets each of the pre-scan LF value, the post-scan LF value, the final left margin, and the final right margin to "0." Below, a subscript of each of the above-described white mask table and color mask table is referred to as an "index."

Main Processing

The main processing executed by the CPU 40 will be explained with reference to FIG. 8 to FIG. 15. When a power switch (not shown in the drawings) of the operation panel 51 shown in FIG. 2 is switched on, the CPU 40 reads a main program from the ROM 41, and executes the main processing.

Figure 8:
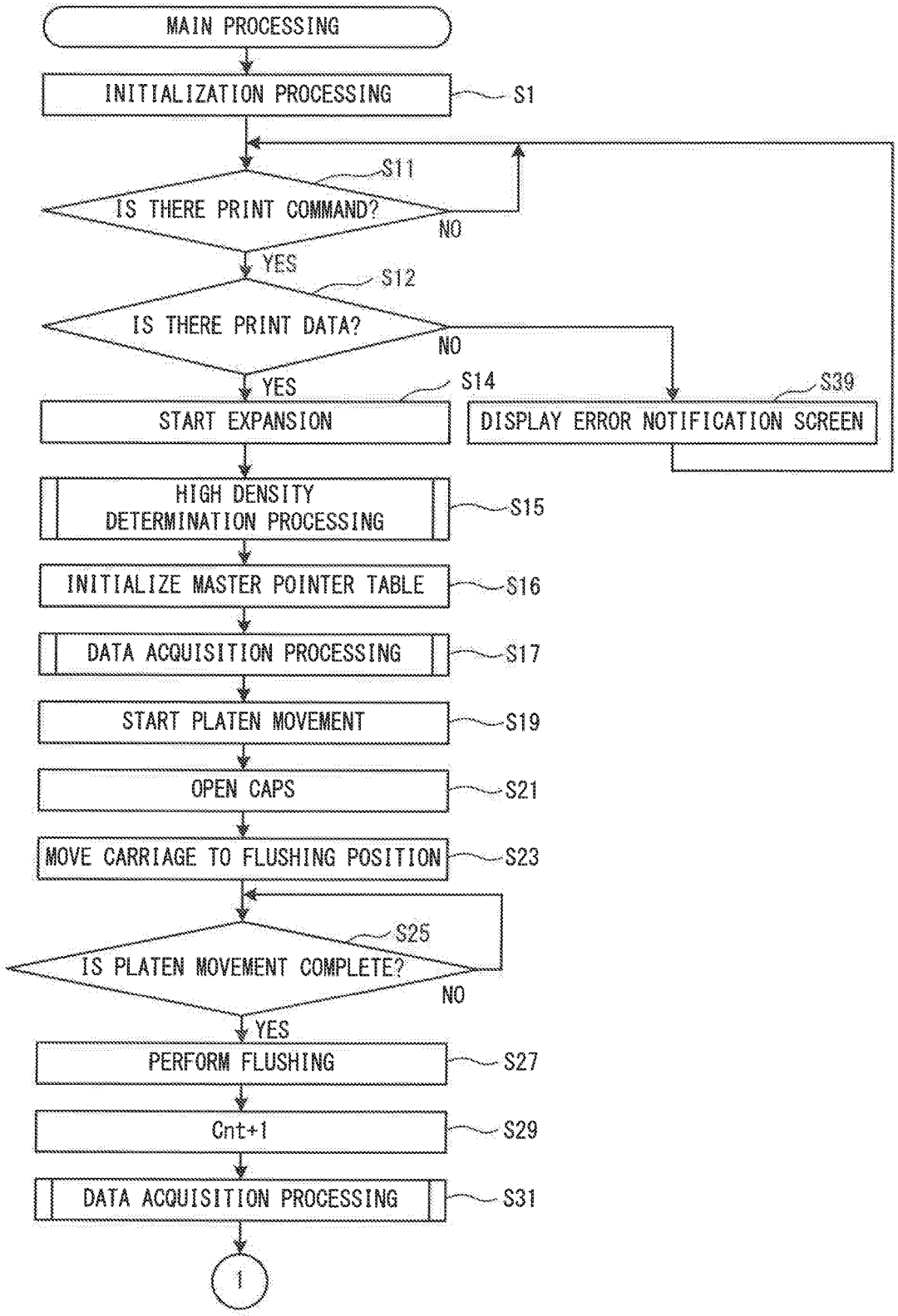
FIG. 8 is a flowchart of main processing.

As shown in FIG. 8, the CPU 40 first performs the initialization processing (step S1). An example of the initialization processing will be explained specifically. The CPU 40 sets a state in which all the ejection heads 35 are covered by caps. The CPU 40 arranges the carriage 34 in an initial position. The CPU 40 moves the platen 39 to a position furthermost to the rear side. The CPU 40 initializes variables stored in the RAM 42. For example, the CPU 40 sets a counter value "Cnt," which indicates a number of main scans (also including a number of times the main scan is not performed where all of the raster data is "0"), to "1." The counter value Cnt corresponds to the "X" of the print buffer [X] 422. The CPU 40 causes fields storing mask values of each of the white mask table [420] and the color mask table [420] (each of which consists of 420 rows of mask values) to be blank columns. The CPU 40 initializes the X number (X=1, 2, . . . ) of the print buffers [X] 422. In other words, as well as setting the pre-scan LF value, the post-scan LF value, the final left margin, and the final right margin to "0," the CPU 40 sets "0" for each of the fields storing the pointers of the read pointer table [8] [420].

As shown in FIG. 8, the CPU 40 determines whether a print command has been received (step S11). More specifically, for example, the CPU 40 determines that the print command has been received when a print button (not shown in the drawings) of the operation panel 51 shown in FIG. 3 has been depressed and a signal of the print command from the terminal device 1 has been received. When the CPU 40 determines that the print command has not been received (no at step S11), the CPU 40 returns the processing to step S11. The CPU 40 continues to monitor for the print command. When the CPU 40 determines that the print command has been received (yes at step S11), the CPU 40 advances the processing to step S12. The CPU 40 determines whether the print data 421 shown in FIG. 7 is stored in the reception buffer 420 (step S12). When the CPU 40 determines that the print data 421 is not stored in the reception buffer 420 (no at step S12), the CPU 40 displays an error notification screen, which indicates that the print data 421 is not stored in the reception buffer 420, on the display 49 shown in FIG. 3 (step S39). The CPU 40 returns the processing to step S11.

When the CPU 40 determines that the print data 421 is stored in the reception buffer 420 (yes at step S12), the CPU 40 starts processing to expand the raster information, of the print data 421 shown in FIG. 7 (step S14). The processing to expand the raster information is performed at the same time as the main processing, by separate processing that is performed in parallel with the main processing. The expanded raster information is stored in the expansion buffer 425 in the RAM 42.

Next, the CPU 40 performs high density determination processing (step S15). The high density determination processing will be explained with reference to FIG. 14. The CPU 40 acquires density information from the header information of the print data 421 (step S151). Next, the CPU 40 determines whether, in the density information, high density information is present that indicates printing at the high density Ph (%) (step S152). An example of the high density information is information that indicates printing at 500(%) or 600(%). When the CPU 40 determines that the high density information is present (yes at step S152), in accordance with the density information of the LF value table 411 shown in FIG. 15 that will be described later, the CPU 40 stores, as a high density LF value table, combinations of the LF values corresponding to remainder values obtained by dividing (Cnt−1) by (D×R) (where Cnt≥2), in the LF value table storage area 426 of the RAM 42 (step S153). For example, when the high density information is information indicating that printing is to be performed at 500(%), when D×R=4, the CPU 40 stores, as the high density LF value table, the LF value combination "335, 335, 335, 339" corresponding to the remainder values "1, 2, 3, 0" obtained by dividing (Cnt−1) (where Cnt≥2) by "4," in the LF value table storage area 426.

Further, when the CPU 40 determines that the high density information is not present (no at step S152), from the LF value table 411, the CPU 40 stores, as the normal LF value table, combinations of the LF values corresponding to remainder values obtained by dividing (Cnt−1) by (D×R) (where Cnt≥2) for printing at a normal density (400% in the specific example), in the LF value table storage area 426 of the RAM 42 (step S154). After completing step S153 or step S154, the CPU 40 advances to step S16 of the main processing shown in FIG. 8.

LF Value Table 411

The LF value table 411 stored in the ROM 41 will be explained with reference to FIG. 15. The LF value table 411 shown in FIG. 15 is an example of a case in which the adjacent D×R pixels are the adjacent four pixels, and n11=n12=n13=−1. In the LF value table 411, the resolution, the density information, and the LF values are associated with each other. The high density information indicating that printing is to be performed at the high density of 500(%) indicates that the pixel arrays of the adjacent four pixels are to be printed at the high density Ph (%)=500(%). The high density information indicating that printing is to be performed at the high density of 600(%) indicates that the pixel arrays of the adjacent four pixels are to be printed at the high density Ph (%)=600(%). The normal density information indicates that the adjacent four pixels are to be printed at the unit density Pu (%)=400(%). In the present specific example, the LF values are associated with the remainder values "1," "2," "3," and "0" obtained by dividing (Cnt−1) (where Cnt≥2) by "4."

The LF values of the LF value table 411 will be explained. In the present specific example, the image with the resolution R (dpi)=1200 (dpi) is formed. Further, 3 dots ({(D/(1/R))−1}=D×R−1) are formed between each of the nozzles 36, as described above. Thus, at the resolution R (dpi)=1200 (dpi), in order to form the adjacent four pixels, the LF values are set in advance in the following manner. First, a reference LF value is calculated. The reference LF value is a value obtained by dividing "420," which is the number N of the nozzles 36, by a ratio (Ph/Pu) of the high density Ph (%) to the unit density Pu (%). The reference LF value is an average value of an LF amount when printing is performed by the multi-pass method at the high density Ph (%). For example, when the high density Ph (%) is 500(%), the reference LF value is "420/(500/400)=336." In the present specific example, n11=n12=n13=−1, and thus, "335" obtained by subtracting "F" from the reference LF value is associated with each of the remainder values "1," "2" and "3" when (Cnt−1) (where Cnt≥2) is divided by "4." In the present specific example, since n2=3, "339" obtained by adding "3" to the reference LF value is associated with the remainder value "0." When the high density Ph (%) is 600(%), the reference LF value is "420/(600/400)=280." In the present specific example, n11=n12=n13=−1, and thus, "279" obtained by subtracting "1" from the reference LF value is associated with each of the remainder values "1," "2" and "3." In the present specific example, since n2=3, "283" obtained by adding "3" to the reference LF value is associated with the remainder value "0." Further, when the density information is normal, the reference LF value is "420." In the present specific example, n11=n12=n13=−1, and thus, "419" obtained by subtracting "1" from the reference LF value is associated with each of the remainder values "1," "2" and "3." In addition, in the present specific example, since n2=3, "423" obtained by adding "3" to the reference LF value is associated with the remainder value "0."

At step S16 of the main processing shown in FIG. 8, the CPU 40 initializes the master pointer table 423 (shown in FIG. 11), which is stored in the RAM 42 (step S16). More specifically, as shown in FIG. 11, head types, nozzles, and pointers are associated with each other in the master pointer table 423. The head types indicate the total of eight ejection heads 35 (the four ejection heads 35W (white 1 to 4), the ejection head 35C (cyan), the ejection head 35M (magenta), the ejection head 35Y (yellow), and the ejection head 35K (black)) mounted on the carriage 34. The nozzles indicate the 420 nozzles 36 of each of the eight ejection heads 35 (hereinafter referred to as a nozzle [1], a nozzle [2], . . . a nozzle [420]). The pointer associated with each of the nozzles 36 is a pointer that indicates, among the raster information stored in the expansion buffer 425, the raster data for the corresponding nozzle 36 to form one row of the pixel array in the main scan direction.

As an example, as the pointer corresponding to the nozzle [1] of the head type "white 1" of the master pointer table 423, the CPU 40 associates the pointer that indicates, from among the raster information stored in the expansion buffer 425, the raster data corresponding to the pixel array number "1" and to the color information "white 1." As the pointer corresponding to the nozzle [2] of the head type "white 1" of the master pointer table 423, the CPU 40 associates the pointer that indicates, from among the raster information stored in the expansion buffer 425, the raster data corresponding to the pixel array number "5" and to the color information "white 1." The reason for this is that the distance between the nozzles 36 of the ejection heads 35W is D, which is four times the interval 1/R between the pixel arrays in the sub scan direction. Thus, the pixel array number corresponding to the nozzle [2] is 5 (=4+1).

Below, as the pointers corresponding to the nozzles [n] (n=1, 2, . . . 420) of the head type "white 1" of the master pointer table 423, the CPU 40 uses the same method to associate the pointers that indicate, from among the raster information, the raster data corresponding to the pixel array numbers "4 (n−1)+1" and to the color information "white 1." The CPU 40 associates the pointers corresponding to the nozzles [1] to [420] of the head types "white 2 to white 4" of the master pointer table 423 using the same method as that described above. In the present embodiment, only the white ink image is formed, and thus, an explanation of the pointers corresponding to the colors is omitted here, but the method for associating the pointers is the same in principle.

As the pointer corresponding to the nozzle [n] of the head type "cyan" of the master pointer table 423, the CPU 40 associates a pointer that indicates, from among the raster information stored in the expansion buffer 425, the raster data corresponding to the pixel array number "4 (420+n−1)+7086" and to the color information "cyan." The reason for adding "7086" is that a distance of separation between the nozzles 36 furthest to the rear of the four white ink ejection heads 35W shown in FIG. 2 and the nozzle 36 furthest to the rear of the cyan ink ejection head 35C is 150 mm in the present specific example. Thus, the pointers are set while taking into account a number of pixel arrays in the distance of separation. The value "7086" is derived by the expression "round {(150/25.4) (in)×1200 (dpi)}." Note that, when the pixel array number calculated by "4 (419+n)+7086" is a negative value, the CPU 40 associates a corresponding pointer of the master pointer table 423 with a pointer indicating raster data in which all of the bits are "0." In this case, the ejection of the cyan ink from the ejection head 35C is started after 7086 pixel arrays have been formed by the ejection of the white ink from the ejection heads 35W. Thus, the cyan ink is ejected so as to overlap with the formed white ink pixel arrays. Using the same method, the CPU 40 associates pointers of the master pointer table 423 corresponding to the nozzles [1] to [420] of the head types "magenta," "yellow," and "black."

Figure 12:
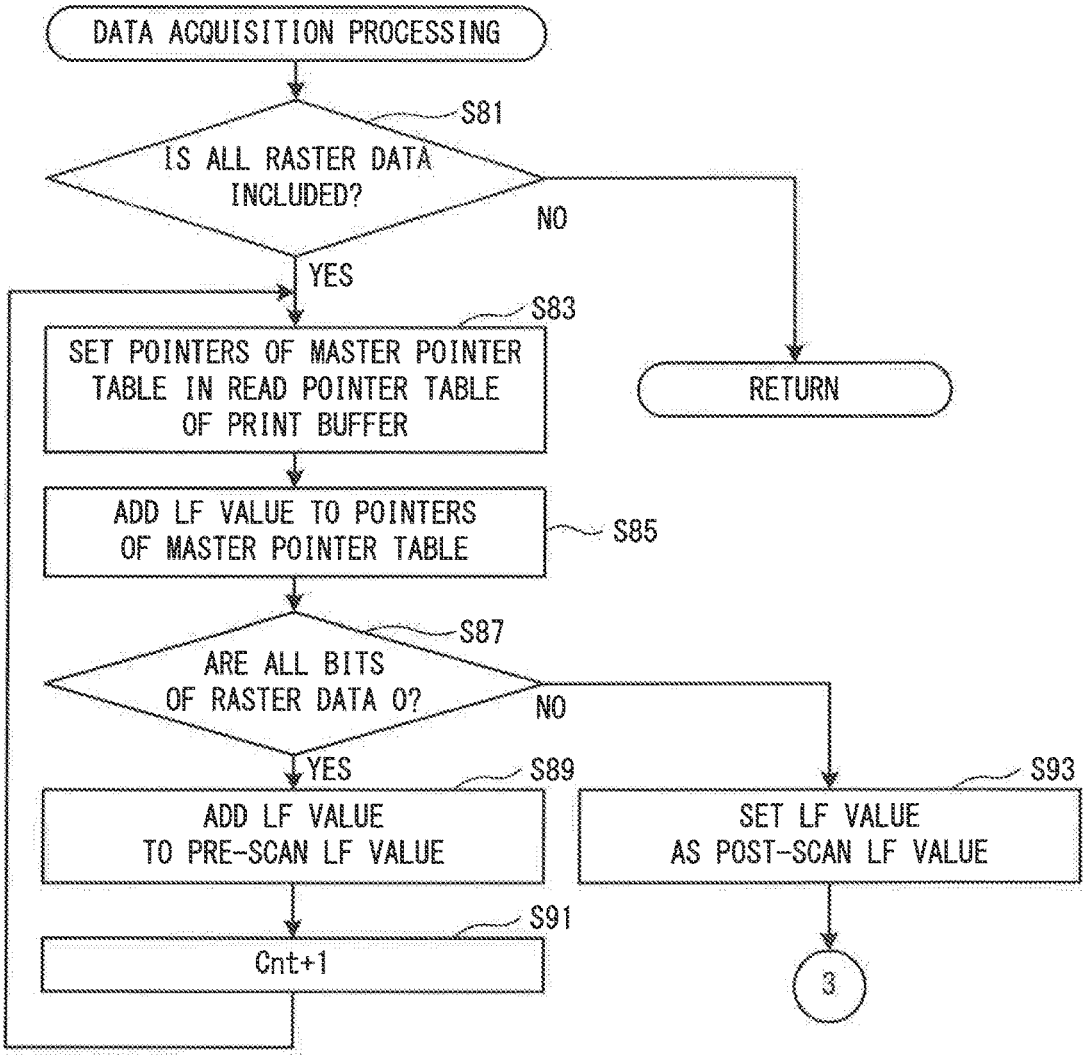
FIG. 12 is a flowchart of data acquisition processing.
Figure 13:
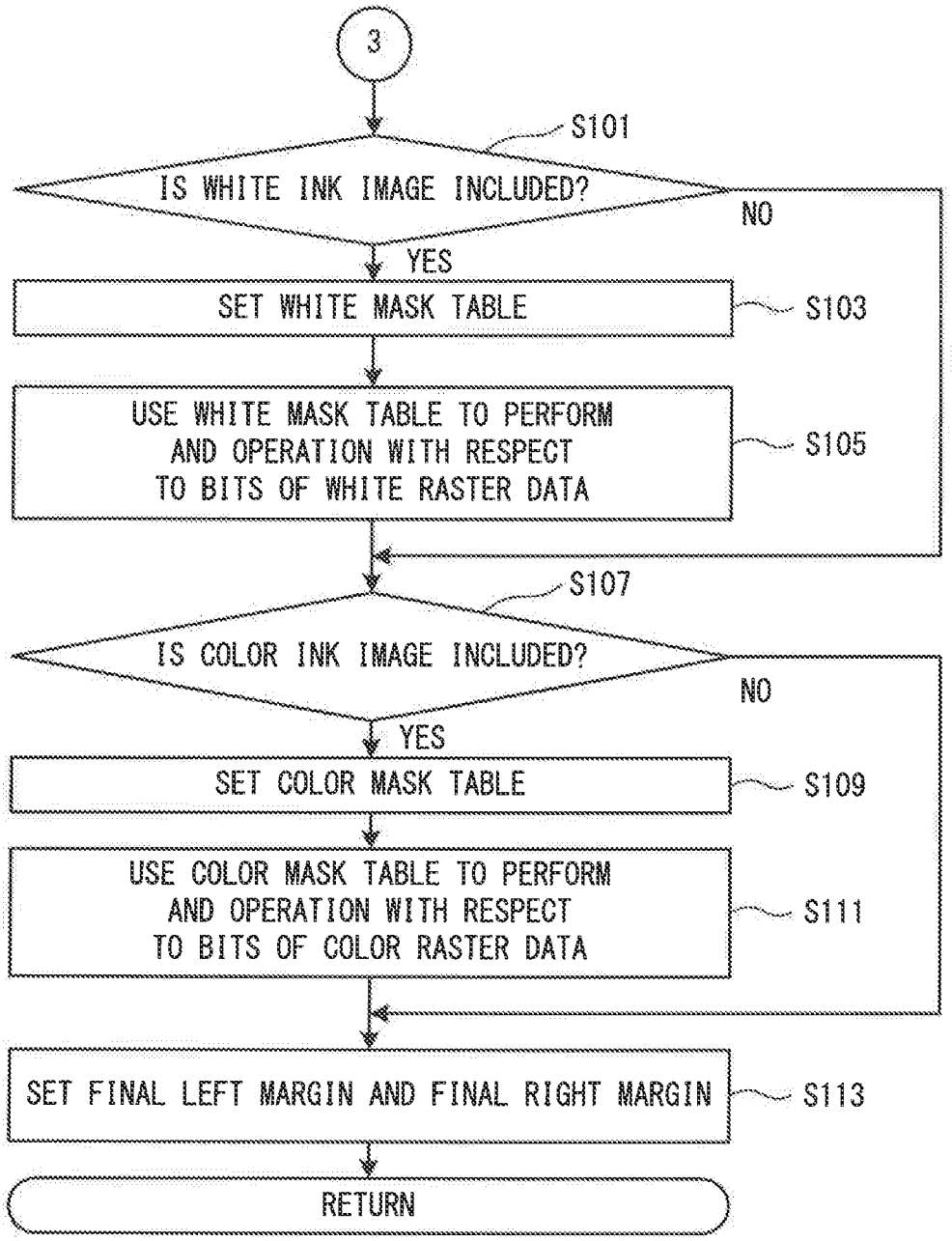
FIG. 13 is a flowchart of the data acquisition processing and is a continuation of FIG. 12.
Figure 14:
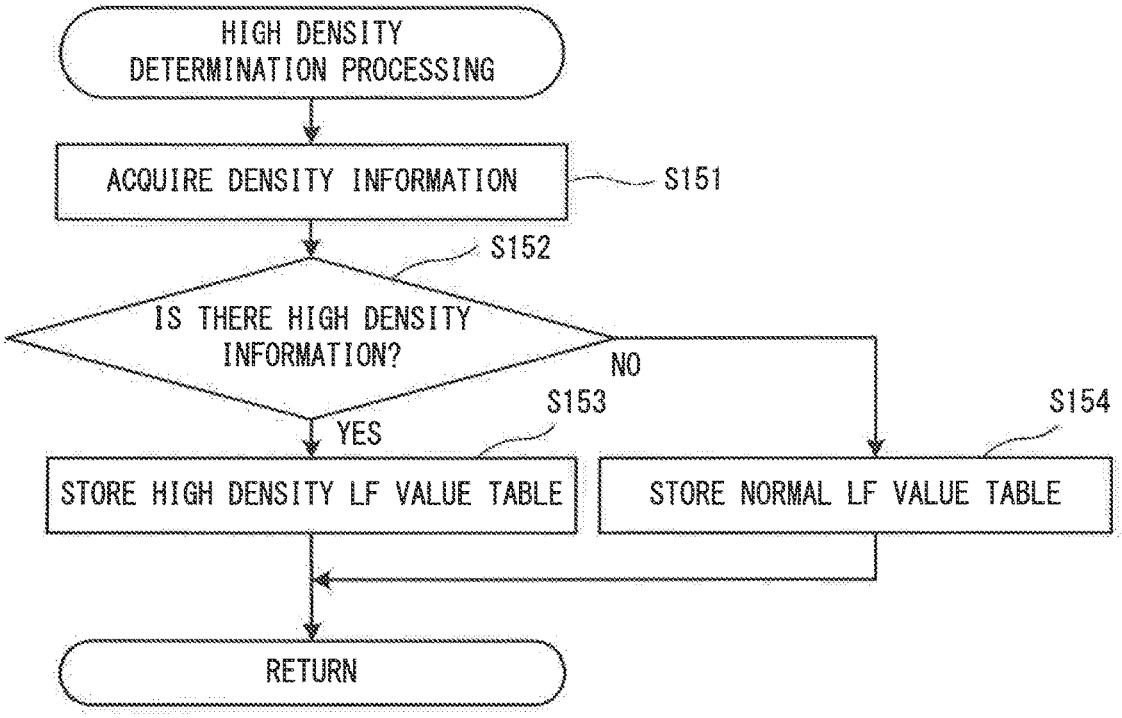
FIG. 14 is a flowchart of high density determination processing.

As shown in FIG. 8, after initializing the master pointer table 423 by the processing at step S16, the CPU 40 performs data acquisition processing shown in FIG. 12 and FIG. 13 (step S17). The data acquisition processing will be explained with reference to FIG. 12 and FIG. 13. In the data acquisition processing, the CPU 40 stores, in the read pointer table [8] [420] of the print buffer [Cnt] 422, the pointer indicating the raster data to be used when causing the carriage 34 to move in the main scan direction for the Cnt-th time.

A flow of specific processing will be explained. The CPU 40 determines whether all of the raster data indicated by the 8×420 pointers in the master pointer table 423 shown in FIG. 11 are included in the raster information stored in the expansion buffer 425 (step S81). When the CPU 40 determines that all the raster data are not included in the raster information (no at step S81), the CPU 40 ends the data acquisition processing. However, it is determined at step S12 of the main processing whether the print data is present, and the main processing from step S14 onward is performed only when the print data is determined to be present. Thus, at step S81 of the data acquisition processing, although a NO determination is not normal, if there is a particular abnormality, NO is determined.

When the CPU 40 determines that all the raster data are included in the raster information (yes at step S81), the CPU 40 advances the processing to step S83. The CPU 40 sets the 8×420 pointers of the master pointer table 423 as the read pointer table [8] [420] of the print buffer [Cnt] 422 (step S83).

Next, the CPU 40 updates the 8×420 pointers of the master pointer table 423 in the following manner. The CPU 40 adds the LF value to the 8×420 pointers of the master pointer table 423 (step S85). More specifically, in the high density determination processing shown in FIG. 14, on the basis of the LF value table 411 stored in the ROM 41, the CPU 40 identifies the LF value corresponding to the remainder value obtained by dividing (Cnt−1) by (D×R) ("4" in the present specific example). The CPU 40 adds the identified LF value to the 8×420 pointers of the master pointer table 423 shown in FIG. 11. Note that, when the remainder value obtained by dividing (Cnt−1) by (D×R) is "0," a value obtained by adding the constant m (m=0, 1, 2, . . . , (D×N−1)) to the identified LF value is added to the 8×420 pointers of the master pointer table 423 shown in FIG. 11. For example, when the density information is 500(%), in the LF value table 411 shown in FIG. 15, the LF values "335, "335, "335" and "339" are set corresponding to the remainder values of "1," "2," "3," and "0" obtained by dividing (Cnt−1) by "4." Thus, when the remainder value obtained by dividing (Cnt−1) by "4" is "1" to "3," the CPU 40 adds the LF value "335" to the 8×420 pointers of the master pointer table 423. Further, when the remainder value obtained by dividing (Cnt−1) by "4" is "0," the CPU 40 adds, to the 8×420 pointers of the master pointer table 423, the value obtained by adding together the LF value "339" and the constant m.

The CPU 40 identifies the 8×420 pieces of raster data indicated by the 8×420 pointers set in the read pointer table [8] [420] of the print buffer ([Cnt] 422 in the processing at step S83. Then, the CPU 40 determines whether all of the bits of the identified 8×420 pieces of raster data are "0." When the CPU 40 determines that all the bits of the 8×420 pieces of raster data are "0" (yes at step S87), the CPU 40 advances the processing to step S89. The CPU 40 adds the value added to the pointers by the processing at step S85 to the pre-scan LF value of the print buffer [Cnt] 422 (step S89). When the print processing is performed on the basis of the raster data in which all the bits of the 8×420 pieces of raster data are "0," the ejection heads 35 do not eject the ink. The CPU 40 adds "1" to the counter value Cnt and updates the counter value Cnt (step S91). The CPU 40 returns the processing to step S83.

On the other hand, when the CPU 40 determines that all the bits of the 8×420 pieces of raster data are not "0" (no at step S87), the CPU 40 sets the value added to the pointers by the processing at step S85 to the post-scan LF value of the print buffer [Cnt] 422 (step S93). The CPU 40 advances the processing to step S101 shown in FIG. 13. The pre-scan LF value and the post-scan LF value calculated by the processing at steps S83 to S93 are used to skip the row in which the pixel array is not formed, and to identify a position after the movement when relatively moving the carriage 34 in the sub scan direction to the row in which the pixel array is formed.

As shown in FIG. 13, the CPU 40 determines whether the white ink image is included in the print method specification information, of the header information of the print data 421 stored in the reception buffer 420 (step S101). When it is determined that the white ink image is included, the information indicating (1) only the white ink image is included or the information indicating (3) both the white ink image and the color ink image are included, is included in the header information. When the CPU 40 determines that the white ink image is not included (no at step S101), the CPU 40 advances the processing to step S107.

When the CPU 40 determines that the white ink image is included (yes at step S101), the CPU 40 performs white mask table settings (step S103). More specifically, when the white ink is ejected from all of the nozzles [1] to [420], the CPU 40 sets "0xffff" ("1111111111111111") as mask values in white mask tables [1] to [420] stored in the white mask table storage area 427 of the RAM 42.

The CPU 40 performs an AND operation using the white mask table on the bits of white raster data (step S105). More specifically, the CPU 40 identifies the 8×420 pieces of raster data indicated by the 8×420 pointers set in the read pointer table [8] [420] of the print buffer [Cnt] 422. From among the identified raster data, the CPU 40 selects 4×420 pieces of raster data corresponding to the four ejection heads 35W that eject the white ink. From among the selected 4×420 pieces of raster data, the CPU 40 performs the AND operation of each of the bits of raster data corresponding to the nozzles [1] to [420] and the mask values "0xffff" set for each of the white mask tables [1] to [420]. When the number of bits of the raster data is larger than "16," the CPU 40 repeatedly applies the values set in the white mask tables, from the first value, to the bits from the $17^{th}$ bit of the raster data onward and performs the AND operation. The CPU 40 stores the results of the AND operation in the white final raster data buffer [4] [420] 429 in the RAM 42, as the white final raster data. Next, the CPU 40 advances the processing to step S107.

The CPU 40 determines whether, as the print method specification information, the information indicating (2) the color ink image is included or the information indicating (3) the white ink image and the color ink image are included is included in the header information of the print data 421 stored in the reception buffer 420 (step S107). When the CPU 40 determines that the information indicating (1) only the white ink image is included is included (no at step S107), the CPU 40 advances the processing to step S113.

The CPU 40 sets the "final left margin" and the "final right margin" of the print buffer [Cnt] 422 (step S113). More specifically, the CPU 40 identifies the 8×420 pieces of raster data indicated by the 8×420 pointers set in the read pointer table [8] [420] of the print buffer [Cnt] 422. From among the raster information stored in the expansion buffer 425, the CPU 40 extracts all of the left margins and the right margins associated with the identified raster data. The CPU 40 sets, as the "final left margin" of the print buffer [Cnt] 422, the smallest left margin from among all of the left margins. The CPU 40 sets, as the "final right margin" of the print buffer [Cnt] 422, the smallest right margin from among all of the right margins. The CPU 40 ends the data acquisition processing and advances the processing to step S19 of the main processing shown in FIG. 8.

When it is determined that the information indicating (2) or (3) is included in the print method specification information (yes at step S107), the CPU 40 sets the color mask table (step S109). More specifically, for example, when the white ink is used to perform the printing of 500% density, at step S109, the CPU 40 sets "0xaaaa" ("1010101010101010") as mask values in color mask tables [1] to [84] stored in the color mask table storage area 428 of the RAM 42. Further, the CPU 40 sets "0xffff" "0xffff" ("1111111111111111") as mask values in color mask tables [85] to [336], and sets "0x5555" ("0101010101010101") as mask values in color mask tables [337] to [420]. In this case, the nozzles [1] to [84] and the nozzles [337] to [420] ejecting the color ink print the same pixel arrays. However, since the mask percentage of the nozzles [1] to [84] is 50%, and the mask percentage of the nozzles [337] to [420] is 50%, the hue of the color ink does not change. Note that, in the present specific example, the movement of the nozzles 36 by an amount corresponding to a reference LF value is performed by the L1 movement three times and the L2 movement once. Thus, since the reference LF value is "336", the number "84" of the front and rear nozzles 36 having the mask percentage of 50% can be calculated by subtracting the reference LF value "336" from the number of nozzles 36, which is 420.

In addition, for example, when the white ink is used to perform the printing of 600% density, at step S109, the CPU 40 sets "0xaaaa" ("1010101010101010") as the mask values in the color mask tables [1] to [140] stored in the color mask table storage area 428 of the RAM 42. Further, the CPU 40 sets "0xffff" ("1111111111111111") as the mask values in the color mask tables [141] to [280], and sets "0x5555" ("0101010101010101") as the mask values in the color mask tables [281] to [420]. In this case, the nozzles [1] to [140] and the nozzles [281] to [420] ejecting the color ink print the same pixel arrays. However, since the mask percentage of the nozzles [1] to [140] is 50%, and the mask percentage of the nozzles [281] to [420] is 50%, the hue of the color ink does not change. Note that, in the present specific example, the movement of the nozzles 36 by an amount corresponding to the reference LF value is performed by the L1 movement three times and the L2 movement once. Further, also in the second L1 movement and the fourth L1 movement, which is the fifth movement overall, it is the same L1 movement. Thus, the same nozzles 36 that scan the same pixel arrays in the first and fourth scans scan the same pixel arrays in the second and fifth scans. As a result, since the reference LF value is "280," the number "140" of the front and rear nozzles 36 having the mask percentage of 50% can be calculated by subtracting the reference LF value "280" from the number of nozzles 36, which is 420.

After ending color mask table setting processing (step S109), the CPU 40 performs an AND operation with respect to each of the bits of the color raster data, using the color mask tables [1] to [420] (step S111). More specifically, the CPU 40 identifies the 8×420 pieces of raster data indicated by the 8×420 pointers set in the read pointer table [8] [420] of the print buffer [Cnt] 422. From among the identified raster data, the CPU 40 selects the 4×420 pieces of raster data corresponding to the ejection heads 35C, 35M, 35Y, and 35K that eject the color inks. From the selected 4×420 pieces of raster data, the CPU 40 further selects the 420 pieces of raster data for each color. The CPU 40 performs the AND operation of each of the bits of the selected 420 pieces of raster data and the mask values set for each of the color mask tables [1] to [420]. The CPU 40 performs the above-described processing with respect to each set of the 420 pieces of raster data corresponding to each of the colors. The CPU 40 stores the results of the AND operation in the color final raster data buffer [4] [420] 430 in the RAM 42, as the color final raster data. The CPU 40 advances the processing to step S113. After the above-described processing at step S113, the CPU 40 ends the data acquisition processing, and advances the processing to step S19 of the main processing shown in FIG. 8.

The CPU 40 starts the movement of the platen 39 to a print start position (step S19). More specifically, the CPU 40 starts the movement of the platen 39 by an amount corresponding to the pre-scan LF value of the print buffer [Cnt=1]. The CPU 40 opens the caps covering the 420 nozzles 36 of each of the four ejection heads 35W, and the ejection heads 35C, 35M, 35Y, and 35K (step S21). The CPU 40 moves the carriage 34 to a flushing position (step S23). The flushing position is a position at which a flushing receptacle (not shown in the drawings) is provided.

The CPU 40 determines whether the movement of the platen 39 by the amount corresponding to the pre-scan LF value started by the processing at step S19 is complete (step S25). When the CPU 40 determines that the movement of the platen 39 by the amount corresponding to the pre-scan LF value is not complete (no at step S25), the CPU 40 returns the processing to step S25. The CPU 40 continuously monitors whether the movement of the platen 39 by the amount corresponding to the pre-scan LF value is complete. When the CPU 40 determines that the movement of the platen 39 by the amount corresponding to the pre-scan LF value is complete (yes at step S25), flushing processing is performed (step S27).

After ending the flushing processing (step S27), the CPU 40 adds "1" to the counter value Cnt and updates the counter value Cnt (step S29). Based on the updated counter value Cnt to which "1" has been added, the CPU 40 performs the data acquisition processing (step S31). The data acquisition processing is the same as the data acquisition processing performed at step S17 shown in FIG. 8, and an explanation thereof is thus omitted here. The CPU 40 advances the processing to step S41 shown in FIG. 9.

Figure 9:
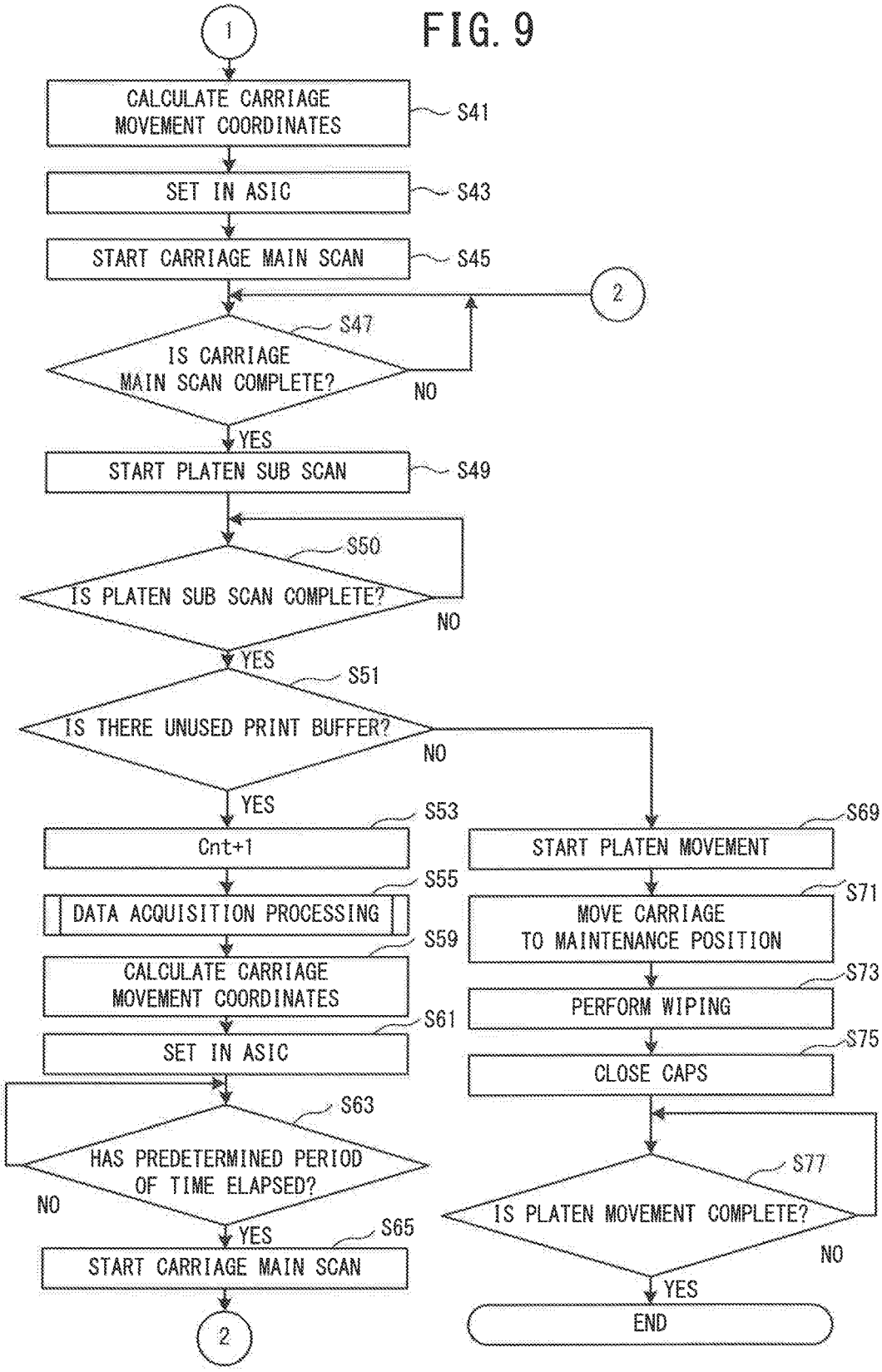
FIG. 9 is a flowchart of the main processing and is a continuation of FIG. 8.

As shown in FIG. 9, the CPU 40 calculates coordinates of each of positions indicated by the final left margin and final right margin, as coordinates of a movement origin and a movement destination of the carriage 34 (step S41). More specifically, the CPU 40 acquires the final left margin and the final right margin of each of the print buffer [Cnt−1] 422 and the print buffer [Cnt] 422. The CPU 40 selects the smaller of the final left margins of the print buffer [Cnt−1] 422 and of the print buffer [Cnt] 422, as the final left margin. Similarly, the CPU 40 selects the smaller of the final right margins of the print buffer [Cnt−1] 422 and of the print buffer [Cnt] 422, as the final right margin. In this way, the movement of the carriage 34 can be optimized. The CPU 40 calculates, as the coordinates of the movement origin and the movement destination of the carriage 34, the coordinates of each of the positions represented by the selected final left margin and final right margin. Next, the CPU 40 sets the calculated coordinates, the read pointer table [8] [420] of the print buffer [Cnt] 422, and the main scan direction, as a print direction, in a storage portion of the ASIC 43 (step S43).

By outputting a signal to the ASIC 43, the CPU 40 starts movement of the carriage 34 in the main scan direction (step S45). More specifically, the ASIC 43 controls the head drive portion 44 and the motor drive portion 45 shown in FIG. 3. As a result of the control of the ASIC 43, the motor drive portion 45 starts the movement of the carriage 34 in the main scan direction. As a result of the control of the ASIC 43, the head drive portion 44 causes the white ink to be ejected from the nozzles 36 at the intervals of 1/R in the main scan direction. Based on the white final raster data, the ASIC 43 controls the head drive portion 44, and causes the white ink to be ejected from the ejection head 35 at a timing at which the bit of the raster data is "1." In contrast, based on the white final raster data, the ASIC 43 controls the head drive portion 44 and prohibits the white ink from being ejected from the ejection head 35 at a timing at which the bit of the raster data is "0." Similarly, based on the color final raster data, the ASIC 43 controls the head drive portion 44, and causes the color ink to be ejected from the ejection head 35 at a timing at which the bit of the raster data is "1." In contrast, based on the color final raster data, the ASIC 43 controls the head drive portion 44 and prohibits the color ink from being ejected from the ejection head 35 at a timing at which the bit of the raster data is "0."

The CPU 40 determines whether the movement of the carriage 34 in the main scan direction is complete (step S47). When the CPU 40 determines that the movement of the carriage 34 in the main scan direction is not complete (no at step S47), the CPU 40 returns the processing to step S47. When the CPU 40 determines that the movement of the carriage 34 in the main scan direction is complete (yes at step S47), the CPU 40 advances the processing to step S49.

The CPU 40 starts the movement of the platen 39 (step S49). More specifically, the CPU 40 acquires the pre-scan LF value and the post-scan LF value of the print buffer [Cnt] 422. The CPU 40 adds together the acquired pre-scan LF value and post-scan LF value and identifies the position of the platen 39 after the movement. The CPU 40 starts to move the platen 39 to the position after the movement. Next, the CPU 40 determines whether the movement of the platen 39 is complete (step S50). When the CPU 40 determines that the movement of the platen 39 is not complete (no at step S50), the CPU 40 returns the processing to step S50. When the CPU 40 determines that the movement of the platen 39 is complete (yes at step S50), the CPU 40 advances the processing to step S51.

The CPU 40 determines whether there is the unused print buffer 422 (step S51). When the CPU 40 determines that there is not the unused print buffer 422 (no at step S51), the CPU 40 advances the processing to step S69. On the other hand, when the CPU 40 determines that there is the unused print buffer 422 (yes at step S51), the CPU 40 adds "1" to the counter value Cnt and updates the counter value Cnt (step S53). Based on the updated counter value Cnt obtained by adding "1" to the counter value Cnt, the CPU 40 performs the data acquisition processing shown in FIG. 12 and FIG. 13 (step S55). The data acquisition processing is the same as the data acquisition processing performed at step S17 shown in FIG. 8, and an explanation thereof is thus omitted here. The CPU 40 advances the processing to step S59.

The CPU 40 calculates coordinates of each of positions indicated by the final left margin and the final right margin, as coordinates of the movement origin and the movement destination of the carriage 34 (step S59). More specifically, the CPU 40 acquires the final left margin and the final right margin of each of the print buffer [Cnt−1] 422 and the print buffer [Cnt] 422. The CPU 40 selects the smaller final left margin, of the final left margins of the print buffer [Cnt−1] 422 and the print buffer [Cnt] 422. Similarly, the CPU 40 selects the smaller final right margin, of the final right margins of the print buffer [Cnt−1] 422 and the print buffer [Cnt] 422. In this way, the movement of the carriage 34 can be optimized. The CPU 40 calculates, as the coordinates of the carriage movement origin and the carriage movement destination, the coordinates of each of the positions indicated by the selected final left margin and final right margin. Next, the CPU 40 sets the calculated coordinates, the read pointer table [8] [420] of the print buffer [Cnt] 422, and the main scan direction, as the print direction, in the storage portion of the ASIC 43 (step S61).

The CPU 40 determines whether a predetermined period of time has elapsed from the determination, at step S47, that the movement of the carriage 34 in the main scan direction is complete (step S63). When the CPU 40 determines that the predetermined period of time has not elapsed (no at step S63), the CPU 40 returns the processing to step S63. When the CPU 40 determines that the predetermined period of time has elapsed (yes at step S63), the CPU 40 advances the processing to step S65. By outputting a signal to the ASIC 43, the CPU 40 starts the movement of the carriage 34 in the main scan direction (step S65). The CPU 40 returns the processing to step S47.

At step S69, the CPU 40 starts to move the platen 39 to the position furthermost to the front side (step S69). The CPU 40 moves the carriage 34 to a maintenance position (step S71). The maintenance position is a position in which a wiper (not shown in the drawings) is provided. The CPU 40 performs wiping (step S73). The wiping is processing to scrape off ink that has attached to the nozzles 36, using a wiper. The CPU 40 causes all of the ejection heads 35 to be in a state of being covered by the caps (step S75). The CPU 40 determines whether the movement of the platen 39 is complete (step S77). When the CPU 40 determines that the movement of the platen 39 is not complete (no at step S77), the CPU 40 returns the processing to step S77. When the CPU 40 determines that the movement of the platen 39 is complete (yes at step S77), the CPU 40 ends the main processing.

Main Operations and Effects

As described above, on the basis of the print buffer [1] 422, the CPU 40 relatively moves the ejection heads 35 in the sub scan direction to the print start position (step S19 of the main processing). Next, on the basis of the print buffer [1] 422, the CPU 40 moves the ejection heads 35 in the main scan direction and causes the white ink to be ejected from the nozzles 36 at the intervals of 1/R in the main scan direction (step S45 of the main processing). Next, the CPU 40 relatively moves the ejection heads 35 in the sub scan direction (step S49 of the main processing). For example, when performing the printing in which the total print density of the pixel arrays of the adjacent four pixels is the high density 500(%), the CPU 40 adds the LF value "335" of the LF value table 411 shown in FIG. 15 to each of the pointers in the read pointer tables [8] [420] of the print buffers [2] 422 to [4] 422 (step S85 of the data acquisition processing). The LF value corresponds to a number of pixels. Thus, the CPU 40 relatively moves the ejection heads 35 in the sub scan direction in increments of (335/R). Next, based on the print buffers [2] 422 to [4] 422, the CPU 40 moves the ejection heads 35 in the main scan direction and causes the white ink to be ejected from the nozzles 36 (step S65 of the main processing). The pixel arrays of the white ink formed in this manner are arranged at the intervals of 1/R in the sub scan direction.

Next, the CPU 40 adds the LF value "339" of the LF value table 411 and the constant m to each of the pointers in the read pointer table [8] [420] of the print buffer [5] 422 (step S85 of the data acquisition processing). The CPU 40 identifies the position after the movement when relatively moving the ejection heads 35 in the sub scan direction, on the basis of the value (the value when the LF value "339" and the constant m are added) added to each of the pointers of the read pointer table [8] [420] of the print buffer [5] 422

(step S49 of the main processing). The CPU 40 relatively moves the ejection heads 35 in the sub scan direction, by an amount corresponding to ((339+m)/R), from the position of the ejection heads 35 when the ink is ejected on the basis of the print buffer [4] 422. Next, the CPU 40 moves the ejection heads 35 in the main scan direction and causes the white ink to be ejected from the nozzles 36 on the basis of the print buffer [5] 422 (step S65 of the main processing). As a result, the CPU 40 ejects the ink on the basis of the print buffer [5] 422 onto the same pixel array as the pixel array onto which the ink was ejected on the basis of the print buffer [m+1] 422. Thus, the print density of the pixel array is 200(%). The print density of the pixel arrays formed on the basis of the print buffers [1] 422 to [4] 422 is 100(%), and thus, the CPU 40 can cause the print density of the pixel arrays of the adjacent four pixels to be 500(%).

As described above, when the CPU 40 performs the printing at the high density Ph (%) in relation to the unit density Pu (%) of the pixel arrays of the adjacent four pixels, the CPU 40 can perform the printing at the high density Ph (%) of 500(%) of the pixel arrays of the adjacent four pixels, using the "multi-pass method" and ejecting the ink by causing the ejection head 35W to scan in the main scan direction five times. As shown in FIG. 4, in order to print the pixel arrays of the adjacent four pixels at the total density of 400(%), the print device 30 performs the print process from processes P11 to P14 four times. Further, as shown in FIG. 5, in order to print the pixel arrays of the adjacent four pixels at the total density of 500(%), the print device 30 performs the print process from processes P11 to P15 five times. As a result, the print time for the high density Ph (%) of 500(%) is five fourths the print time for 400(%). In contrast, in the printing method of the high density Ph (%) of 500(%) in the related art, the print time is twice that of the time to print the adjacent four pixels at 400(%), as described above. Specifically, when printing the adjacent four pixels at the high density Ph (%) of 500(%), in the related art, it is necessary to perform the main scan eight times. As a result, in the present embodiment, the print time for the high density Ph (%) can be shortened in comparison to the related art.

Further, for example, when the white ink is used to perform the printing at the high density of 500%, the nozzles [1] to [84] and the nozzles [337] to [420] ejecting the color ink print the same pixel arrays. However, the mask percentage of the nozzles [1] to [84] is 50%, the mask percentage of the nozzles [337] to [420] is 50%, and the mask percentage of the nozzles [85] to [336] is 100%. Thus, a total amount of ink ejected from the nozzles [1] to [84] and the nozzles [337] to [420] is the same as an amount of ink ejected from the nozzles [85] to [336], and the unevenness in the density of the color ink image in the sub scan direction can be suppressed.

In addition, for example, when the CPU 40 performs the printing at the high density of 600%, the nozzles [1] to [140] and the nozzles [281] to [420] ejecting the color ink print the same pixel arrays. However, the mask percentage of the nozzles [1] to [140] is 50%, the mask percentage of the nozzles [281] to [420] is 50%, and the mask percentage of the nozzles [85] to [280] is 100%. Thus, a total amount of ink ejected from the nozzles [1] to [140] and the nozzles [281] to [420] is the same as an amount of ink ejected from the nozzles [141] to [280], and the unevenness in the density of the color ink image in the sub scan direction can be suppressed.

As described above, the CPU 40 can suppress the unevenness in the density of the color ink image in the sub scan direction by a simple method, by using the color mask tables and controlling the ejection of the color ink of each of the nozzles 36 ejecting the color ink. Further, the color mask table is configured by 1 bit data, and thus the data is small and a data transfer speed is also improved. As a result, a low-priced CPU can be used as the CPU 40.

Modified Example 1

Figure 6:
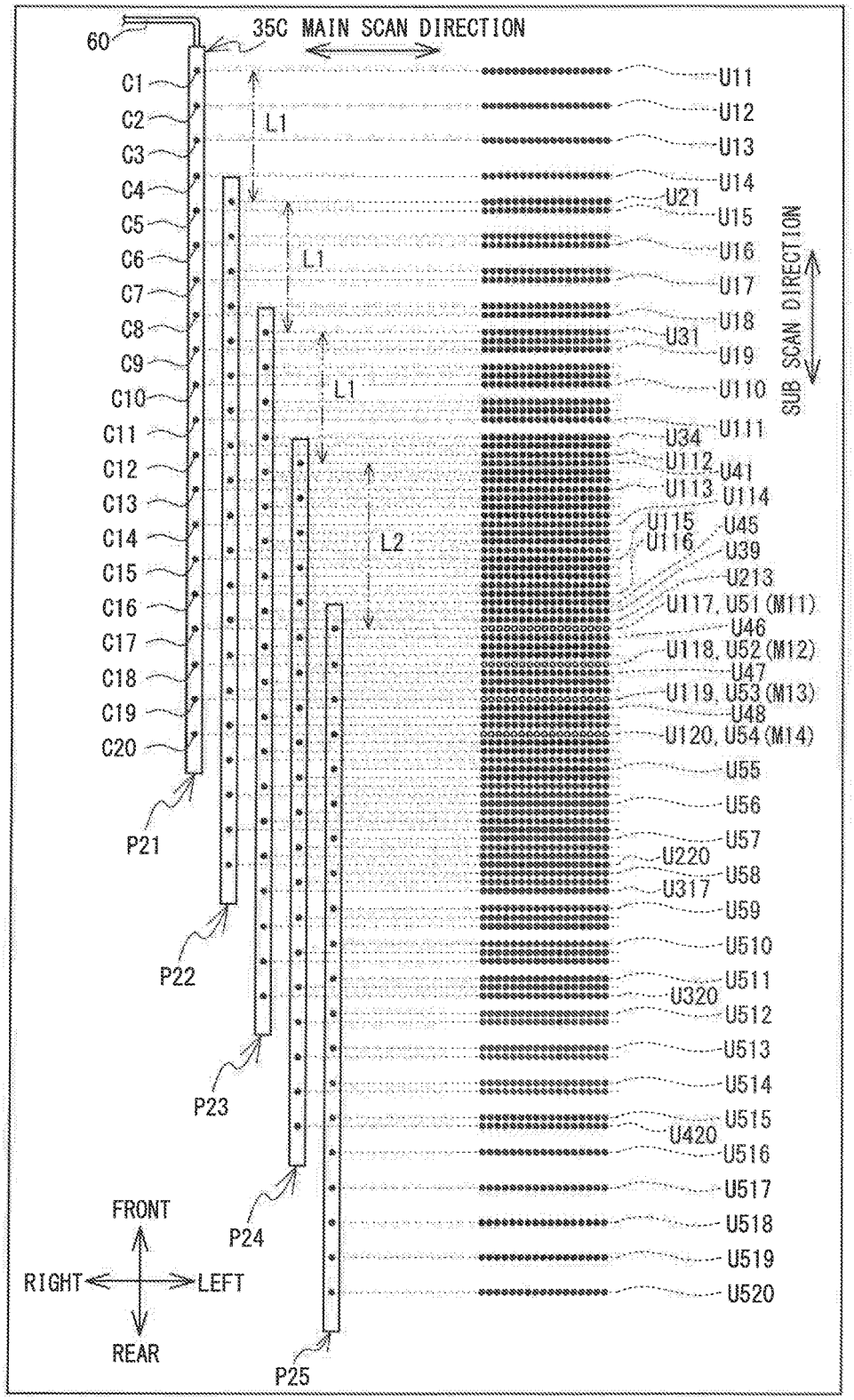
FIG. 6 is a diagram showing a process for forming a color ink image using an ejection head.

In the specific example shown in FIG. 6, the CPU 40 uses the color mask table and controls the ejection of the color ink from each of the nozzles 36 ejecting the color ink, thus performing control such that the density of the pixel arrays M11 to M14 formed by the multi-pass method is the same as that of the other pixel arrays. For example, the percentages of the number of times the cyan ink is ejected from the nozzle C1 and the nozzle C17 forming the pixel array M11 may be caused to be 50%:50%, and the percentages of the number of times the cyan ink is ejected from the nozzle C2 and the nozzle C18 forming the pixel array M12 may be caused to be 50%:50%. Further, the percentages of the number of times the cyan ink is ejected from the nozzle C3 and the nozzle C19 forming the pixel array M13 may be caused to be 100%:0%. Further, the percentages of the number of times the cyan ink is ejected from the nozzle C4 and the nozzle C20 forming the pixel array M14 may be caused to be 100%:0%. As described above, using the multi-pass method, a plurality of combinations may be set in which the total of the percentages of the number of times the ink is ejected from the two nozzles 36 forming the single pixel array is 100%. If the percentage of the number of times the ink is ejected from the nozzles 36 decreases, the amount of ink ejected by a single ejection decreases. Thus, with respect to a color with a low percentage of the number of times the ink is ejected, it is possible to inhibit the amount of the ink ejected by the single ejection from decreasing by setting the percentages of the number of times the ink is ejected to 100%:0%. As a result, the unevenness of the density can be suppressed. Further, with respect to a color with a high percentage of the number of times the ink is ejected, by setting the percentages of the number of times the ink is ejected to 50%:50%, banding can be inhibited.

Specifically, the main scan of (number of nozzles N−reference LF value) of the pixel arrays is performed twice. Thus, settings may be performed such that the total percentage of the number of times the cyan ink is ejected by the combinations of the nozzles 36 forming each of the pixel arrays from the nozzle [1] to the nozzle [N−reference LF value], and from the nozzle [reference LF value+1] to the nozzle [N] is 100%, and the cyan ink is ejected onto all of the pixels of the pixel arrays.

Modified Example 2

The CPU 40 may make a range of the nozzles 36 that cause the percentage of the number of times the color ink is ejected from the nozzles 36 of the ejection head 35 ejecting the color ink to be a percentage other than 100% wider than a range of the nozzles 36 that cause the percentage of the number of times the white ink is ejected to be a percentage other than 100%. In the case of the color ink, in order to suppress the unevenness of the density, it is necessary to make the amount of ink of the pixel arrays formed using the multi-pass method to be the same as the amount of ink of the pixel arrays that are not formed using the multi-pass method. In the present modified example 2, since an amount of droplets of the ink ejected from the nozzles 36 fluctuates, the unevenness of the density of the color ink can be suppressed by making the range of the nozzles 36 that cause the percentage of the number of times the color ink is ejected from the nozzles 36 to be a percentage other than 100% wider than the range of the nozzles 36 that cause the percentage of the number of times the white ink is ejected to be a percentage other than 100%. This is because the range of the nozzles 36 that cause the percentage of the number of times of the ink ejection to be a percentage other than 100% is made wider, and as a result, it is less likely for the unevenness in the density to occur due to the influence of movement error of the nozzles 36.

As an example, a case will be explained in which the adjacent four pixels are printed at the density of 500% using the white ink. The nozzles [361] to [420] of the ejection heads 35W that eject the white ink are far from the ink supply path 60 and there is thus a risk of ejection failure. Therefore, the ejection of the white ink is not set to 100% and is set to 25%. The ejection of the nozzles [1] to [60] of the ejection heads 35W of the white ink is set to 75%, and, by overlapping the white ink ejected by the nozzles [1] to [60] and the nozzles [361] to [420], the possibility of the occurrence of missing pixels due to ejection failure can be reduced. In this case, the LF values are "287, 287, 287, and 291." This is because the reference LF value is "288 (=(420−60)/(500/400))." Further, since the ejection heads 35C, 35K, 35M, and 35Y ejecting the color inks are mounted on the same carriage 34 as the ejection heads 35W, the LF values are "287, 287, 287, and 291." However, the mask percentage of each of the nozzles [1] to [132] of the ejection heads 35C, 35K, 35M, and 35Y of the color inks is 50%, the mask percentage of the nozzles [289] to [420] is 50%, and the mask percentage of the nozzles [133] to [288] is 100%. In this case, the number of the nozzles 36 ejecting the white ink for which the mask percentage is not 100% is 60+60=120. The number of the nozzles 36 ejecting the color inks for which the mask percentage is not 100% is 132+132=264. Thus, the (number of nozzles 36 ejecting the white ink for which the mask percentage is not 100%) is smaller than the (number of nozzles 36 ejecting the color inks for which the mask percentage is not 100%).

In addition, as an example, a case will be explained in which the adjacent four pixels are printed at the density of 600% using the white ink. The nozzles [361] to [420] of the ejection heads 35W that eject the white ink are far from the ink supply path 60 and there is thus a risk of ejection failure. Therefore, the ejection of the white ink is not set to 100% and is set to 25%. The ejection of the nozzles [1] to [60] of the ejection heads 35W of the white ink is set to 75%, and, by overlapping the white ink ejected by the nozzles [1] to [60] and the nozzles [361] to [420], the possibility of the occurrence of missing pixels due to ejection failure can be reduced. In this case, the LF values are "239, 239, 239, and 243." This is because the reference LF value is "240 (=(420−60)/(600/400))." Further, since the ejection heads 35C, 35K, 35M, and 35Y ejecting the color inks are mounted on the same carriage 34 as the ejection heads 35W, the LF values are "239, 239, 239, and 243." However, the mask percentage of each of the nozzles [1] to [180] of the ejection heads 35C, 35K, 35M, and 35Y of the color inks is 50%, the mask percentage of the nozzles [241] to [420] is 50%, and the mask percentage of the nozzles [181] to [240] is 100%. In this case, the number of the nozzles 36 ejecting the white ink for which the mask percentage is not 100% is 60+60=120. The number of the nozzles 36 ejecting the color inks for which the mask percentage is not 100% is 180+180=360. Thus, the (number of nozzles 36 ejecting the white ink for which the mask percentage is not 100%) is smaller than the (number of nozzles 36 ejecting the color inks for which the mask percentage is not 100%).

The present disclosure is not limited to the above-described embodiment and each of the modified examples, and various modifications are possible. In the specific example shown in FIG. 4 to FIG. 6, an example of the combination of "n11, n12, n13, and n2" in the processes P12 to P15 and the processes P22 to P25 is "−1, −1, −1, 3," but the combination need not necessarily be limited to this example, and may be "−1, −2, 1, 2," "−2, 1, −2, 3," "−2, −1, 2, 1," "−3, 2, −1, 2," "−3, 1, 1, 1," and so on.

In the above description, the print device 30 ejects the white ink from the nozzles 36 of the four ejection heads 35W. The print device 30 ejects the cyan ink, the magenta ink, the yellow ink, and the black ink from the nozzles 36 of each of the ejection heads 35C, 35M, 35Y, and 35K. In contrast to this, the colors of the inks ejected from the nozzles 36 of the four ejection heads 35W and the ejection heads 35C, 35M, 35Y, and 35K may be colors that are different to the colors of the above-described embodiment.

The number (eight) of the ejection heads 35, the number (420) of the nozzles 36, the distance (1/300 in) between the adjacent nozzles 36 in the sub scan direction, and the distance (150 mm) between the nozzles 36 on the rearmost side of each of the four ejection heads 35W and the nozzles 36 on the rearmost side of each of the ejection heads 35C, 35M, 35Y and 35K in the description above are examples, and may be other values.

The arrangement of the four ejection heads 35W and the ejection heads 35C, 35M, 35Y, and 35K is not limited to the above-described example, and may be another arrangement. The number of the ejection heads 35W is not limited to four, and may be one to three, or may be five or more. The ejection heads 35K may be not mounted on the carriage 34. The number of the nozzles 36 included in the four ejection heads 35W may be smaller than the number of the nozzles 36 included in each of the ejection heads 35C, 35M, 35Y, and 35K. Of the 420 nozzles 36 of the ejection head 35W, the number of the nozzles 36 in which clogging is likely to occur is not limited to 60 (the 361-st to 420-th nozzles 36), and may be another number.

The above-described embodiment and each of the modified examples can also be applied when the printing is performed by moving the platen 39 without moving the ejection heads 35. In other words, it is sufficient if the print device 30 moves the platen 39 and causes the platen 39 to move relatively with respect to the ejection heads 35 in the main scan direction and the sub scan direction. Further, the above-described embodiment and modified examples can also be applied when the printing is performed by moving the ejection heads 35 in the main scan direction and the sub scan direction.

In the above-described embodiment and each of the modified examples, at step S113 of the data acquisition processing, the CPU 40 identifies the 8×420 pieces of raster data indicated by the 8×420 pointers set in the read pointer table [8] [420] of the print buffer [Cnt] 422. Next, of the raster information stored in the expansion buffer 425, the CPU 40 extracts all of the left margins and the right margins associated with the identified raster data. Then, the CPU 40 sets, as the "final left margin" of the print buffer [Cnt] 422, the smallest of the left margins among all the left margins. In addition, the CPU 40 sets, as the "final right margin" of the print buffer [Cnt] 422, the smallest of the right margins among all the right margins. Then, at step S41 of the main processing, the CPU 40 acquires each of the final left margins and the final right margins of the print buffer

[Cnt−1] 422 and the print buffer [Cnt] 422. Next, the CPU 40 selects the smaller final left margin, of the final left margins of the print buffer [Cnt−1] 422 and the print buffer [Cnt] 422. Similarly, the CPU 40 selects the smaller final right margin, of the final right margins of the print buffer [Cnt−1] 422 and the print buffer [Cnt] 422. As described above, the respective coordinates of the movement origin and the movement destination of the carriage 34 are calculated on the basis of the selected final left margin and final right margin.

However, the respective coordinates of the movement origin and the movement destination of the carriage 34 may be calculated using the method explained below. At step S113 of the data acquisition processing, the CPU 40 respectively identifies the 8×420 pieces of raster data respectively indicated by the 8×420 pointers set in the read pointer tables [8] [420] of the print buffer [Cnt−1] 422 and the print buffer [Cnt] 422. Next, of the raster information stored in the expansion buffer 425, the CPU 40 extracts all of the left margins and the right margins associated with the identified raster data. Then, the CPU 40 sets, as the "final left margin" of the print buffer [Cnt] 422, the smallest of the left margins among all the left margins. Further, the CPU 40 sets, as the "final right margin" of the print buffer [Cnt] 422, the smallest of the right margins among all the right margins. Then, at step S41 and step S59 of the main processing, when calculating the movement coordinates of the carriage 34, the CPU 40 acquires each of the final left margin and the final right margin of the print buffer [Cnt] 422. Next, the CPU 40 calculates the respective coordinates of the movement origin and the movement destination of the carriage 34 on the basis of the acquired final left margin and final right margin.

Figure 3:
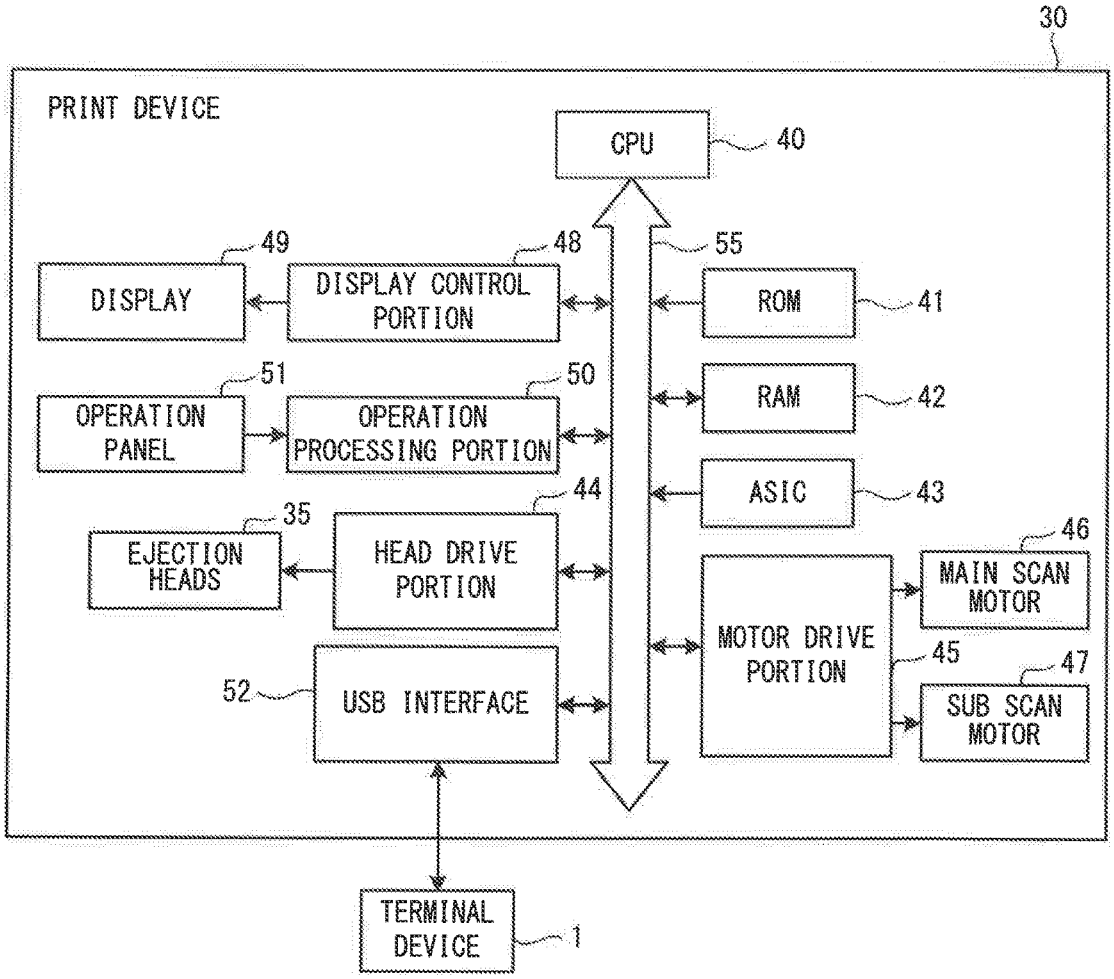
FIG. 3 is a block diagram showing an electrical configuration of the print device.

The CPU 40 shown in FIG. 3 loads various programs stored in a nonvolatile storage device (not shown in the drawings) (a flash memory, for example) to the RAM 42, and performs various processing while using the RAM 42 as a working memory.

Note that the various programs to perform the above-described operations may be stored on a disk device or the like of a server device on the Internet, and the various programs may be downloaded to a computer of the print device 30.

Note also that, depending on an embodiment, other types of storage device apart from the ROM 41 and the RAM 42 may be used. For example, the print device 30 may have a storage device, such as a content addressable memory (CAM), a static random access memory (SRAM), a synchronous dynamic random access memory (SDRAM) or the like.

Note also that, depending on an embodiment, the electrical configuration of the print device 30 may be different to that shown in FIG. 3, and other hardware apart from the standards and types exemplified in FIG. 3 can be applied to the print device 30.

For example, the control portion of the print device 30 shown in FIG. 3 may be realized by a hardware circuit. Specifically, in place of the CPU 40, the control portion may be realized by a reconfigurable circuit, such as a field programmable gate array (FPGA), or an ASIC and the like. Of course, the control portion may be realized by both the CPU 40 and the hardware circuit.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An image formation device comprising:

a plurality of first nozzles arranged at an interval D [in] in a sub scan direction, and configured to eject a first ink;

a plurality of second nozzles arranged at the interval D [in] in the sub scan direction, and configured to eject a second ink;

a processor; and a memory storing computer-readable instructions that, when executed by the processor, cause the processor to:

form an image of a resolution R [dpi], by relatively moving the first nozzles and the second nozzles in a main scan direction with respect to a print medium and causing the first ink and/or the second ink to be ejected, and relatively moving the first nozzles and the second nozzles in the sub scan direction with respect to the print medium, on the basis of print data, and perform an ejection control, when printing of adjacent D×R pixels, which are a number D×R of pixels adjacent to each other in the sub scan direction, is performed by the first ink at a high density Ph [%] that is higher than a unit density Pu [%], which is a maximum density of the first ink able to be ejected at one time from the first nozzles that eject the first ink, with respect to a pixel array formed in the main scan direction corresponding to pixels that are scanned a plurality of times in the main scan direction within the adjacent D×R pixels, such that total densities of the second ink ejected onto each of the pixels in the pixel array by the plurality of times of scanning are, respectively, substantially the same as a maximum density of the second ink able to be ejected at one time from the second nozzles.

2. The image formation device according to claim 1, wherein the memory further stores computer-readable instructions, when executed by the processor, cause the processor to:

perform a determination control configured to determine whether to perform printing of the adjacent D×R pixels at the high density Ph [%], which is higher than the unit density Pu [%], on the basis of the print data, and perform the ejection control, when it is determined to perform the printing at the high density Ph [%], with respect to the pixel array formed in the main scan direction corresponding to the pixels that are scanned the plurality of times in the main scan direction within the adjacent D×R pixels, such that the total densities of the second ink ejected onto each of the pixels in the pixel array by the plurality of times of scanning are, respectively, caused to be the maximum density of the second ink able to be ejected at one time from the second nozzles.

3. The image formation device according to claim 2, wherein the memory further stores computer-readable instructions, when executed by the processor, cause the processor to:

perform the determination control configured to determines whether to perform the printing with respect to the adjacent D×R pixels at the high density Ph [%] that is higher than the unit density Pu [%], by determining whether the print data includes a command to perform the printing with respect to the adjacent D×R pixels at the high density Ph [%] that is higher than the unit density Pu [%].

4. The image formation device according to claim 1, further comprising:

a first head provided with the plurality of first nozzles; and a second head provided with the plurality of second nozzles, wherein the memory further stores computer-readable instructions, when executed by the processor, cause the processor to:

form the image of the resolution R [dpi], by relatively moving the first head and the second head in the main scan direction with respect to the print medium and causing the first ink and the second ink to be ejected, and relatively moving the first head and the second head in the sub scan direction with respect to the print medium, on the basis of the print data.

5. The image formation device according to claim 1, wherein the memory further stores computer-readable instructions, when executed by the processor, cause the processor to:

perform an identification control configured to identify an ejection start position of the second ink in the sub scan direction on the basis of a shortest distance between the first nozzles and the second nozzles.

6. The image formation device according to claim 1, further comprising:

a storage device configured to store a mask pattern which can identify a position of a pixel in the main scan direction at which the second ink is ejected, wherein the memory further stores computer-readable instructions, when executed by the processor, cause the processor to:

identify a position at which the second ink is ejected, among the pixels of the pixel array, on the basis of the mask pattern, and cause the total densities of the second ink ejected onto each of the pixels in the pixel array to be the maximum density of the second ink that is able to be ejected from the second nozzles at one time.

7. The image formation device according to claim 1, wherein the memory further stores computer-readable instructions, when executed by the processor, cause the processor to:

cause a total percentage of a number of times the second ink is ejected onto the pixel array by the plurality of times of scanning to be 100%, and cause the second ink to be ejected onto all of the pixels of the pixel array.

8. The image formation device according to claim 1, wherein the memory further stores computer-readable instructions, when executed by the processor, cause the processor to:

make a range of the second nozzles that cause a percentage of a number of times the second ink is ejected from the second nozzles to be a percentage other than 100% wider than a range of the first nozzles that cause a percentage of a number of times the first ink is ejected from the first nozzles to be a percentage other than 100%.

9. The image formation device according to claim 1, wherein the second ink is a color ink.

* * * * *